US007564981B2

(12) United States Patent
Croft, III

(10) Patent No.: US 7,564,981 B2
(45) Date of Patent: Jul. 21, 2009

(54) METHOD OF ADJUSTING LINEAR PARAMETERS OF A PARAMETRIC ULTRASONIC SIGNAL TO REDUCE NON-LINEARITIES IN DECOUPLED AUDIO OUTPUT WAVES AND SYSTEM INCLUDING SAME

(75) Inventor: James J. Croft, III, Poway, CA (US)

(73) Assignee: American Technology Corporation, San Diego, CA (US)

( * ) Notice: Subject to any disclaimer, the term of this patent is extended or adjusted under 35 U.S.C. 154(b) by 230 days.

(21) Appl. No.: 10/577,116

(22) PCT Filed: Oct. 21, 2004

(86) PCT No.: PCT/US2004/034922

§ 371 (c)(1),
(2), (4) Date: Feb. 8, 2007

(87) PCT Pub. No.: WO2005/043771

PCT Pub. Date: May 12, 2005

(65) Prior Publication Data

US 2007/0189548 A1 Aug. 16, 2007

(51) Int. Cl.
*H04B 3/00* (2006.01)

(52) U.S. Cl. ..... 381/77; 367/137

(58) Field of Classification Search ..... 381/77, 381/79; 367/137, 138

See application file for complete search history.

(56) References Cited

U.S. PATENT DOCUMENTS 1,616,639 A 2/1927 Sprague
1,643,791 A 9/1927 Slepian
1,764,008 A 6/1930 Crozier
1,799,053 A 3/1931 Mache
1,809,754 A 6/1931 Steedle (Continued)

FOREIGN PATENT DOCUMENTS

EP 0 599 250 6/1994

(Continued)

OTHER PUBLICATIONS

Ultrasonic Ranging System by Polaroid Corporation.

(Continued)

*Primary Examiner*—Xu Mei
(74) *Attorney, Agent, or Firm*—Thorpe North & Western LLP

(57) ABSTRACT

A method and system of producing a parametric ultrasonic wave to be decoupled in air to create a decoupled audio wave that closely corresponds to an audio input signal. The method is comprised of ascertaining 402 a linear response over a predefined frequency range of an acoustic output of an electro-acoustical emitter to be used for parametric ultrasonic output. A parametric ultrasonic processed signal is then created by adjusting 404 linear parameters of at least one sideband frequency range of a parametric ultrasonic signal to compensate for the linear response of the acoustic output of the electro-acoustical emitter such that when the parametric ultrasonic processed signal is emitted from the electro-acoustical emitter, the parametric ultrasonic wave is propagated, having sidebands that are closely matched at least at a predefined point in space over the at least one sideband frequency range.

23 Claims, 14 Drawing Sheets

U.S. PATENT DOCUMENTS

| | | | |
|---|---|---|---|
| 1,951,669 | A | 3/1934 | Ramsey |
| 1,983,377 | A | 12/1934 | Kellogg |
| 2,461,344 | A | 2/1949 | Olson |
| 2,855,467 | A | 10/1958 | Curry |
| 2,872,532 | A | 2/1959 | Buchmann et al. |
| 2,935,575 | A | 5/1960 | Bobb |
| 2,975,243 | A | 3/1961 | Katella |
| 2,975,307 | A | 3/1961 | Schroeder et al. |
| 3,008,013 | A | 11/1961 | Williamson et al. |
| 3,012,107 | A | 12/1961 | Hanlet |
| 3,012,222 | A | 12/1961 | Hagemann |
| 3,136,867 | A | 6/1964 | Brettell |
| 3,345,469 | A | 10/1967 | Rod |
| 3,373,251 | A | 3/1968 | Seeler |
| 3,389,226 | A | 6/1968 | Peabody |
| 3,398,810 | A | 8/1968 | Clark, III |
| 3,461,421 | A | 8/1969 | Stover |
| 3,544,733 | A | 12/1970 | Reylek |
| 3,612,211 | A | 10/1971 | Clark, III |
| 3,613,069 | A | 10/1971 | Cary, Jr. |
| 3,641,421 | A | 2/1972 | Graf et al. |
| 3,654,403 | A | 4/1972 | Bobb |
| 3,674,946 | A | 7/1972 | Winey |
| 3,710,332 | A | 1/1973 | Tischner et al. |
| 3,723,957 | A | 3/1973 | Damon |
| 3,742,433 | A | 6/1973 | Kay et al. |
| 3,787,642 | A | 1/1974 | Young, Jr. |
| 3,821,490 | A | 6/1974 | Bobb |
| 3,825,834 | A | 7/1974 | Stuart et al. |
| 3,829,623 | A | 8/1974 | Willis et al. |
| 3,833,771 | A | 9/1974 | Collinson |
| 3,836,951 | A | 9/1974 | Geren et al. |
| 3,892,927 | A | 7/1975 | Lindenberg |
| 3,908,098 | A | 9/1975 | Kawakami et al. |
| 3,919,499 | A | 11/1975 | Winey |
| 3,941,946 | A | 3/1976 | Kawakami et al. |
| 3,961,291 | A | 6/1976 | Whitehouse et al. |
| 3,997,739 | A | 12/1976 | Kishikawa et al. |
| 4,005,278 | A | 1/1977 | Gorike |
| 4,015,089 | A | 3/1977 | Ishii et al. |
| 4,056,742 | A | 11/1977 | Tibbetts |
| 4,064,375 | A | 12/1977 | Russell et al. |
| 4,160,882 | A | 7/1979 | Driver |
| 4,166,197 | A | 8/1979 | Moog et al. |
| 4,207,571 | A | 6/1980 | Passey |
| 4,210,786 | A | 7/1980 | Winey |
| 4,242,541 | A | 12/1980 | Ando |
| 4,245,136 | A | 1/1981 | Krauel, Jr. |
| 4,265,122 | A | 5/1981 | Cook et al. |
| 4,284,921 | A | 8/1981 | Lemonon et al. |
| 4,289,936 | A | 9/1981 | Civitello |
| 4,295,214 | A | 10/1981 | Thompson |
| 4,322,877 | A | 4/1982 | Taylor |
| 4,378,596 | A | 3/1983 | Clark |
| 4,385,210 | A | 5/1983 | Marquiss |
| 4,418,248 | A | 11/1983 | Mathis |
| 4,418,404 | A | 11/1983 | Gordon et al. |
| 4,419,545 | A | 12/1983 | Kuindersma |
| 4,429,193 | A | 1/1984 | Busch-Vishniac et al. |
| 4,429,194 | A | 1/1984 | Kamon et al. |
| 4,432,079 | A | 2/1984 | Mackelburg et al. |
| 4,433,750 | A | 2/1984 | Neese |
| 4,434,327 | A | 2/1984 | Busch-Vishniac et al. |
| 4,439,642 | A | 3/1984 | Reynard |
| 4,471,172 | A | 9/1984 | Winey |
| 4,480,155 | A | 10/1984 | Winey |
| 4,550,228 | A | 10/1985 | Walker et al. |
| 4,558,184 | A | 12/1985 | Busch-Vishniac et al. |
| 4,593,160 | A | 6/1986 | Nakamura |
| 4,593,567 | A | 6/1986 | Isselstein et al. |
| 4,600,891 | A | 7/1986 | Taylor, Jr. et al. |
| 4,672,591 | A | 6/1987 | Breimesser et al. |
| 4,695,986 | A | 9/1987 | Hossack |
| 4,751,419 | A | 6/1988 | Takahata |
| 4,784,915 | A | 11/1988 | Sakagami et al. |
| 4,803,733 | A | 2/1989 | Carver et al. |
| 4,809,355 | A | 2/1989 | Drefahl |
| 4,823,908 | A | 4/1989 | Tanaka et al. |
| 4,837,838 | A | 6/1989 | Thigpen et al. |
| 4,885,781 | A | 12/1989 | Seidel |
| 4,887,246 | A | 12/1989 | Hossack et al. |
| 4,888,086 | A | 12/1989 | Hossack et al. |
| 4,903,703 | A | 2/1990 | Igarashi et al. |
| 4,908,805 | A | 3/1990 | Sprenkels et al. |
| 4,939,784 | A | 7/1990 | Bruney |
| 4,991,148 | A | 2/1991 | Gilchrist |
| 4,991,687 | A | 2/1991 | Oyaba et al. |
| 5,054,081 | A | 10/1991 | West |
| 5,095,509 | A | 3/1992 | Volk |
| 5,115,672 | A | 5/1992 | McShane et al. |
| 5,142,511 | A | 8/1992 | Kanai et al. |
| 5,153,859 | A | 10/1992 | Chatigny et al. |
| 5,181,301 | A | 1/1993 | Wheeler |
| 5,287,331 | A | 2/1994 | Schindel et al. |
| 5,317,543 | A | 5/1994 | Grosch |
| 5,357,578 | A | 10/1994 | Taniishi |
| 5,392,358 | A | 2/1995 | Driver |
| 5,430,805 | A | 7/1995 | Stevenson et al. |
| 5,487,114 | A | 1/1996 | Dinh |
| 5,539,705 | A | 7/1996 | Akerman et al. |
| 5,638,456 | A | 6/1997 | Conley et al. |
| 5,662,190 | A | 9/1997 | Abe |
| 5,700,359 | A | 12/1997 | Bauer |
| 5,745,582 | A | 4/1998 | Shimpuku et al. |
| 5,748,758 | A | 5/1998 | Menasco, Jr. et al. |
| 5,758,177 | A | 5/1998 | Gulick et al. |
| 5,767,609 | A | 6/1998 | Suganuma |
| 5,844,998 | A | 12/1998 | Nageno |
| 5,859,915 | A | 1/1999 | Norris |
| 5,885,129 | A | 3/1999 | Norris |
| 5,889,870 | A | 3/1999 | Norris |
| 5,892,315 | A | 4/1999 | Gipson et al. |
| 5,982,805 | A | 11/1999 | Kaneda |
| 6,011,855 | A | 1/2000 | Selfridge et al. |
| 6,044,160 | A | 3/2000 | Norris |
| 6,052,336 | A | 4/2000 | Lowrey, III |
| 6,064,259 | A | 5/2000 | Takita |
| 6,104,825 | A | 8/2000 | Thigpen |
| 6,108,427 | A | 8/2000 | Norris et al. |
| 6,108,433 | A | 8/2000 | Norris |
| 6,151,398 | A | 11/2000 | Norris |
| 6,188,772 | B1 | 2/2001 | Norris et al. |
| 6,229,899 | B1 | 5/2001 | Norris et al. |
| 6,232,833 | B1 | 5/2001 | Pullen |
| 6,304,662 | B1 | 10/2001 | Norris et al. |
| 6,359,990 | B1 | 3/2002 | Norris |
| 6,378,010 | B1 | 4/2002 | Burks |
| 6,445,804 | B1 | 9/2002 | Hirayanagi |
| 6,556,687 | B1 | 4/2003 | Manabe |
| 6,577,738 | B2 | 6/2003 | Norris et al. |
| 6,584,205 | B1 | 6/2003 | Croft, III |
| 6,666,374 | B1 | 12/2003 | Green et al. |
| 6,768,376 | B2 | 7/2004 | Hoyt et al. |
| 6,771,785 | B2 | 8/2004 | Pompei |
| 6,859,096 | B2 | 2/2005 | Tanaka et al. |
| 7,181,025 | B2 * | 2/2007 | Kolano et al. ..... 381/77 |
| 7,319,763 | B2 * | 1/2008 | Bank et al. ..... 381/77 |
| 7,343,017 | B2 * | 3/2008 | Norris et al. ..... 381/77 |
| 2001/0007591 | A1 | 7/2001 | Pompei |
| 2002/0101360 | A1 | 8/2002 | Schrage |

2002/0191808 A1 12/2002 Croft, III et al.
2005/0185800 A1* 8/2005 Croft, III ..... 381/77

FOREIGN PATENT DOCUMENTS

| | | | |
|---|---|---|---|
| EP | 0 973 152 | | 1/2000 |
| JP | 360021695 | A | 2/1985 |
| JP | 2265397 | | 10/1990 |
| JP | H2-265400 | | 10/1990 |
| WO | WO 98/49868 | | 4/1998 |
| WO | WO 99/35881 | | 7/1999 |
| WO | WO 99/35884 | | 7/1999 |
| WO | WO 01/08449 | | 2/2001 |
| WO | WO 01/33902 | | 5/2001 |
| WO | WO 01/52437 | | 7/2001 |

OTHER PUBLICATIONS

Excerpts From on Combination Tones by Helmholtz, Editor's Comments on Paper 16, pp. 228-238.
Aoki, Kenichi et al. Parametric Loudspeaker—Characteristics of Acoustic Field and Suitable Modulation of Carrier Ultrasound, Electronics and Communications in Japan, Part 3, vol. 74, No. 9, pp. 76-82 (1991).
Makarov et al, "Parametric Acoustic Nondirectional Radiator", Acustica, vol. 77, pp. 240-242 (1992).
Yoneyama, et al, "The Audio Spotlight: An Application of Nonlinear Interaction of Sound Waves to a New Type of Loudspeaker Design", J. Acoustical Society of America 73(5), May 1983, pp. 1532-1536.
Crandall, I.B. The Air-Damped Vibrating System: Theoretica lCalibration of the Condenser Transmitter, American Physical Society, Dec. 28, 1917, pp. 449-460.
Peter J. W., "Parametric Acoustic Array", The Journal of the Acoustical Society of America, vol. 35, No. 1, Apr. 1963, pp. 535-537.
Wagner, Ronald, Electrostatic Loudspeaker Design and Construction, Chapters 4 and 5, pp. 59-91, Audio Amateur Press Publishers, 1993.
Berktay, H.O., "Possible Exploitation of Non-Linear Acoustics in Underwater Transmitting Applications", Department of Electronic and Electrical Engineering University of Birmingham, Edgbaston, Birmingham 15, England (Received Apr. 13, 1965).
Berktay, H.O. et al. "Arrays of Parametric Receiving Arrays," The Journal of the Acoustical Society fo America, pp. 1377-1383.
Piwnicki, Konrad, "Modulation Methods Related to Sine-Wave Crossings" IEEE Transactions on Communications, 1983, pp. 503-508, vol. COM-31, No. 4.
Marvasti, Farokh, "Modulation Methods Related to Sine Wave Crossings" IEEE Transactions on Communications, 1985, pp. 177-178, vol. COM-33, No. 2.
Pompei; The Use of Airborne Ultrasonics for Generating Audible Sound Beams; Presented at the 105th Convention Sep. 26-29, 1998.
Moffett et al. "Model for parametric acoustic sources." J. Acoust. Soc. Am., Feb. 1977, pp. 325-337, vol. 61. No. 2.
Kamakura, et al.; Suitable Modulation of the Carrier Ultrasound for Parametric Loudspeaker; Acustica vol. 73 (1991).
Berktay, et al.; Nearfield effects in end-fire line arrays; The Journal of the Acoustical Society of America; 1973; pp. 550-556.
Kamakura et al. "Developments of Parametric Loundspeaker for Practical Use." 10th International Symposium on Nonlinear Acoustics, 1984, pp. 147-150.
Muir, et al.; Parametric Acoustic Transmitting Arrays; The Journal of the Acousticval Society of America; 1972; pp. 1481-1485.
Kite et al. "Parametric Array in Air: Distortion Reduction by Preprocessing," Applied Research Laboratories, University of Texas, 2 pages.
Kite et al. "Parametric Array in Air: Distortion Reduction by Preprocessing," Applied Research Laboratories, University of Texas, 11 pages.
Willette et al. "Harmonics of the difference frequency in saturation-limited parametric sources." J. Acoust. Soc. Am., Dec. 1977, pp. 1377-1381, vol. 62, No. 6.

* cited by examiner

METHOD OF ADJUSTING LINEAR PARAMETERS OF A PARAMETRIC ULTRASONIC SIGNAL TO REDUCE NON-LINEARITIES IN DECOUPLED AUDIO OUTPUT WAVES AND SYSTEM INCLUDING SAME

BACKGROUND OF THE INVENTION

1. Field of the Invention

The present invention relates generally to the field of parametric sound systems. More particularly, the present invention relates to a method of producing a parametric ultrasonic output wave to be decoupled in air to create an decoupled audio wave that more closely corresponds to the audio input signal.

2. Related Art

Audio reproduction has long been considered a well-developed technology. Over the decades, sound reproduction devices have moved from a mechanical needle on a tube or vinyl disk, to analog and digital reproduction over laser and many other forms of electronic media. Advanced computers and software now allow complex programming of signal processing and manipulation of synthesized sounds to create new dimensions of listening experience, including applications within movie and home theater systems. Computer generated audio is reaching new heights, creating sounds that are no longer limited to reality, but extend into the creative realms of imagination.

Nevertheless, the actual reproduction of sound at the interface of electro-mechanical speakers with the air has remained substantially the same in principle for almost one hundred years. Such speaker technology is clearly dominated by dynamic speakers, which constitute more than 90 percent of commercial speakers in use today. Indeed, the general class of audio reproduction devices referred to as dynamic speakers began with the simple combination of a magnet, voice coil and cone, driven by an electronic signal. The magnet and voice coil convert the variable voltage of the signal to mechanical displacement, representing a first stage within the dynamic speaker as a conventional multistage transducer. The attached cone provides a second stage of impedance matching between the electrical transducer and air envelope surrounding the transducer, enabling transmission of small vibrations of the voice coil to emerge as expansive compression waves that can fill an auditorium. Such multistage systems comprise the current fundamental approach to reproduction of sound, particularly at high energy levels.

A lesser category of speakers, referred to generally as film or diaphragmatic transducers, rely on movement of a large emitter surface area of film (relative to audio wavelength) that is typically generated by electrostatic or planar magnetic driver members. Although electrostatic speakers have been an integral part of the audio community for many decades, their popularity has been quite limited. Typically, such film emitters are known to be low-power output devices having applications appropriate only to small rooms or confined spaces. With a few exceptions, commercial film transducers have found primary acceptance as tweeters and other high frequency devices in which the width of the film emitter is equal to or less than the propagated wavelength of sound. Attempts to apply larger film devices have resulted in poor matching of resonant frequencies of the emitter with sound output, as well as a myriad of mechanical control problems such as maintenance of uniform spacing from the stator or driver, uniform application of electromotive fields, phase matching, frequency equalization, etc As with many well-developed technologies, advances in the state of the art of sound reproduction have generally been limited to minor enhancements and improvements within the basic fields of dynamic and electrostatic systems. Indeed, substantially all of these improvements operate within the same fundamental principles that have formed the basics of well-known audio reproduction. These include the concept that (i) sound is generated at a speaker face, (ii) based on reciprocating movement of a transducer (iii) at frequencies that directly stimulate the air into the desired audio vibrations. From this basic concept stems the myriad of speaker solutions addressing innumerable problems relating to the challenge of optimizing the transfer of energy from a dense speaker mass to the almost massless air medium that must propagate the sound.

A second fundamental principle common to prior art dynamic and electrostatic transducers is the fact that sound reproduction is based on a linear mode of operation. In other words, the physics of conventional sound generation relies on mathematics that conform to linear relationships between absorbed energy and the resulting wave propagation in the air medium. Such characteristics enable predictable processing of audio signals, with an expectation that a given energy input applied to a circuit or signal will yield a corresponding, proportional output when propagated as a sound wave from the transducer.

In such conventional systems, maintaining the air medium in a linear mode is extremely important. If the air is driven excessively into a nonlinear state, severe distortion occurs and the audio system is essentially unacceptable. This nonlinearity occurs when the air molecules adjacent the dynamic speaker cone or emitter diaphragm surface are driven to excessive energy levels that exceed the ability of the air molecules to respond in a corresponding manner to speaker movement. In simple terms, when the air molecules are unable to match the movement of the speaker so that the speaker is loading the air with more energy than the air can dissipate in a linear mode, then the a nonlinear response occurs, leading to severe distortion and speaker inoperability. Conventional sound systems are therefore built to avoid this limitation, ensuring that the speaker transducer operates strictly within a linear range.

Parametric sound systems, however, represent an anomaly in audio sound generation. Instead of operating within the conventional linear mode, parametric sound can only be generated when the air medium is driven into a nonlinear state. Within this unique realm of operation, audio sound is not propagated from the speaker or transducer element. Instead, the transducer is used to propagate carrier waves of high-energy ultrasonic bandwidth beyond human hearing. The ultrasonic wave therefore functions as the carrier wave, which can be modulated with audio input that develops sideband characteristics capable of decoupling in air when driven to the nonlinear condition. In this manner, it is the air molecules and not the speaker transducer that will generate the audio component of a parametric system. Specifically, it is the sideband component of the ultrasonic carrier wave that energizes the air molecule with audio signal, enabling eventual wave propagation at audio frequencies.

Another fundamental distinction of a parametric speaker system from that of conventional audio is that high-energy transducers as characterized in prior art audio systems do not appear to provide the necessary energy required for effective parametric speaker operation. For example, the dominant dynamic speaker category of conventional audio systems is well known for its high-energy output. Clearly, the capability of a cone/magnet transducer to transfer high energy levels to surrounding air is evident from the fact that virtually all high-power audio speaker systems currently in use rely on large dynamic speaker devices. In contrast, low output devices such as electrostatic and other diaphragm transducers are virtually unacceptable for high power requirements. As an obvious example, consider the outdoor audio systems that service large concerts at stadiums and other outdoor venues. It is well known that massive dynamic speakers are necessary to develop direct audio to such audiences. To suggest that a low power film diaphragm might be applied in this setting would be considered foolish and impractical.

Yet in parametric sound production, the present inventors have discovered that a film emitter will outperform a dynamic speaker in developing high power, parametric audio output. Indeed, it has been the general experience of the present inventors that efforts to apply conventional audio practices to parametric devices will typically yield unsatisfactory results. This has been demonstrated in attempts to obtain high sound pressure levels, as well as minimal distortion, using conventional audio techniques. It may well be that this prior art tendency of applying conventional audio design to construction of parametric sound systems has frustrated and delayed the successful realization of a commercial parametric sound. This is evidenced by the fact that prior art patents on parametric sound systems have utilized high energy, multistage bimorph transducers comparable to conventional dynamic speakers. Despite widespread, international studies in this area, none of these parametric speakers were able to perform in an acceptable manner.

In summary, whereas conventional audio systems rely on well accepted acoustic principles of (i) generating audio waves at the face of the speaker transducer, (ii) based on a high energy output device such as a dynamic speaker, (iii) while operating in a linear mode, the present inventors have discovered that just the opposite design criteria are preferred for parametric applications. Specifically, effective parametric sound is effectively generated using (i) a comparatively low-energy film diaphragm, (ii) in a nonlinear mode, (iii) to propagate an ultrasonic carrier wave with a modulated sideband component that is decoupled in air (iv) at extended distances from the face of the transducer. In view of these distinctions, it is not surprising that much of the conventional wisdom developed over decades of research in conventional audio technology is simply inapplicable to problems associated with the generation parametric sound.

One specific area of conventional audio technology that is largely inapplicable to transducer design is in the field of pre-processing an electrical signal prior to its emission from a transducer. While many traditional signal processing techniques are well known as means to enhance the acoustical output of a conventional audio speaker, these techniques are largely inadequate when applied to the field of parametric sound systems. This is because it has been unnecessary for traditional signal processing techniques to account for the non-linear distortion that is often created when parametric ultrasonic waves decouple in air as a non-linear medium to form a decoupled audio wave. Conventional audio technology would simply not need to worry about the non-linearity of air, since they are purposely built such that the air will remain in a substantially linear range. While some of the traditional signal processing techniques may be applied to parametric audio systems, and may even enhance the decoupled audio wave to some degree, these traditional techniques are largely inadequate when it comes to eliminating non-linear distortion caused by the non-linearity of air in which parametric speakers operate.

What is needed is a system and method for substantially accounting for and eliminating the non-linear distortion that is often created when parametric ultrasonic waves decouple in air as a non-linear medium to form a decoupled audio wave.

SUMMARY OF THE INVENTION

It has been recognized that it would be advantageous to develop a method and a parametric speaker system that reproduces a decoupled audio wave that closely corresponds to an audio input signal by eliminating the non-linear, secondary audio distortion created when parametric ultrasonic waves decouple in air as a non-linear medium to form a decoupled audio wave.

The present invention provides a method of producing a parametric ultrasonic wave to be decoupled in air to create a decoupled audio wave that closely corresponds to an audio input signal. The method comprises ascertaining a linear response over a predefined frequency range of an acoustic output of an electro-acoustical emitter to be used for parametric ultrasonic output. The method also includes creating a parametric ultrasonic processed signal by adjusting linear parameters of at least one sideband frequency range of a parametric ultrasonic signal to compensate for the linear response of the acoustic output of the electro-acoustical emitter such that when the parametric ultrasonic processed signal is emitted from the electro-acoustical emitter, the parametric ultrasonic wave is propagated, having sidebands that are more closely matched at a predefined point in space over the at least one sideband frequency range.

The invention also provides a method of producing a parametric ultrasonic wave to be decoupled in air to create a decoupled audio wave that closely corresponds to an audio input signal. The method includes ascertaining a linear response over a predefined frequency range of an acoustic output of an electro-acoustical emitter to be used for parametric ultrasonic output. The method also includes creating a parametric ultrasonic processed signal by adjusting linear parameters of a parametric ultrasonic signal to compensate for the linear response of the acoustic output of the electro-acoustical emitter such that when the parametric ultrasonic processed signal is emitted from the electro-acoustical emitter, the parametric ultrasonic wave is propagated, having a modulation index that is optimized at a predefined point in space over at least one sideband frequency range.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention.

DETAILED DESCRIPTION

Figure 1A:
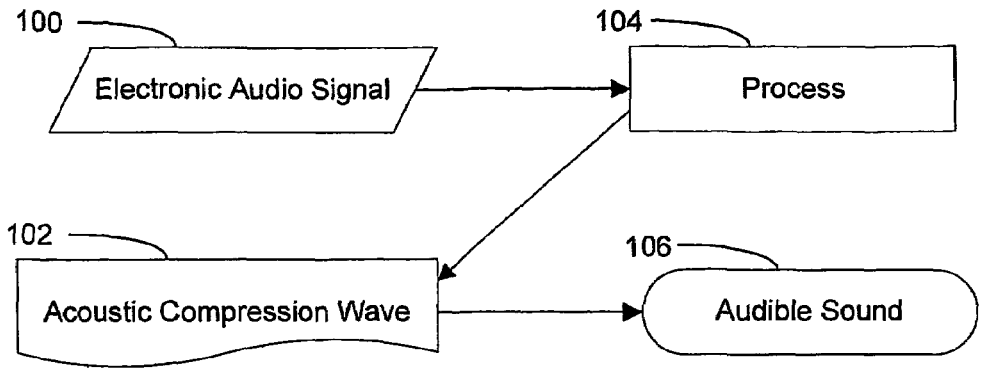
FIG. 1*a* is a reference diagram for FIGS. 1*b* and 1*c*.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Because parametric sound is a relatively new and developing field, and in order to identify the distinctions between parametric sound and conventional audio systems, the following definitions, along with explanatory diagrams, are provided. While the following definitions may also be employed in future applications from the present inventor, the definitions are not meant to retroactively narrow or define past applications or patents from the present inventor or his associates.

Figure 1B:
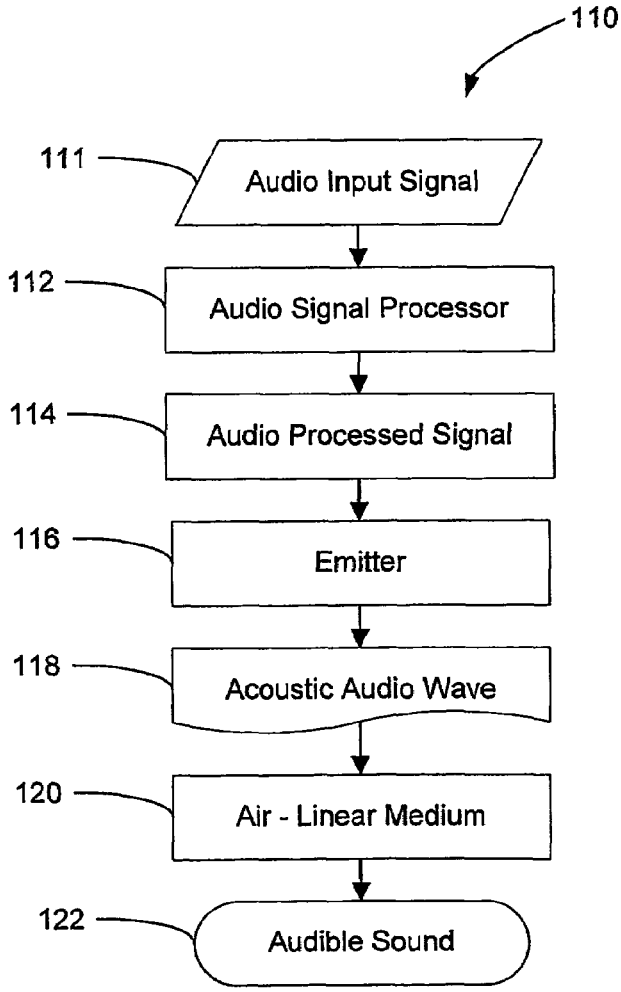
FIG. 1*b* is a block diagram of a conventional audio system.
Figure 1C:
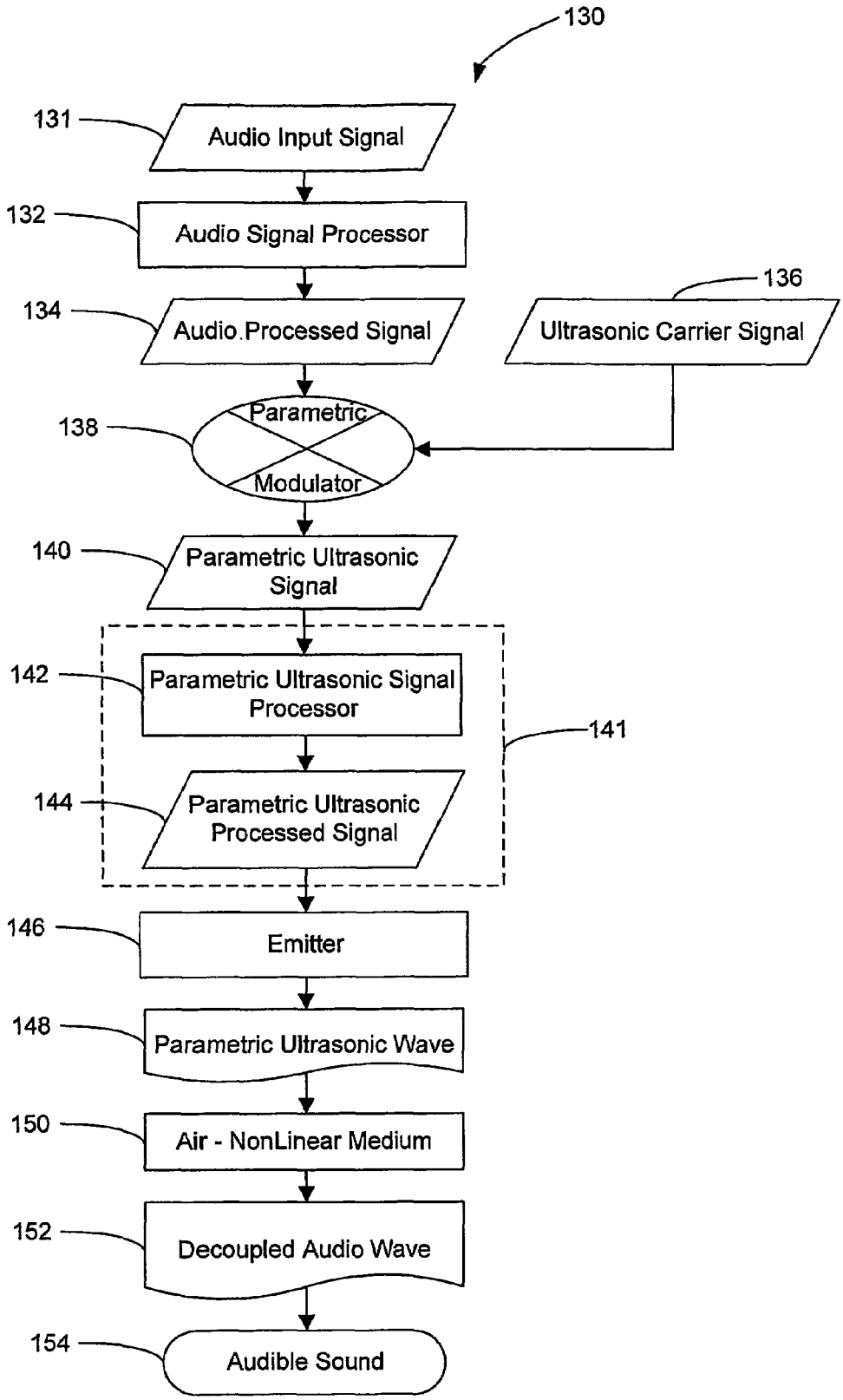
FIG. 1*c* is flow diagram illustrating the complexities of a parametric audio system, and defining the terminology of a parametric audio system.

FIG. 1*a* serves the purpose of establishing the meanings that will be attached to various block diagram shapes in FIGS. 1*b* and 1*c*. The block labeled 100 will represent any electronic audio signal. Block 100 will be used whether the audio signal corresponds to a sonic signal, an ultrasonic signal, or a parametric ultrasonic signal. Throughout this application, any time the word 'signal' is used, it refers to an electronic representation of an audio component, as opposed to an acoustic compression wave.

The block labeled 102 will represent any acoustic compression wave. As opposed to an audio signal, which is in electronic form, an acoustic compression wave is propagated into the air. The block 102 representing acoustic compression waves will be used whether the compression wave corresponds to a sonic wave, an ultrasonic wave, or a parametric ultrasonic wave. Throughout this application, any time the word 'wave' is used, it refers to an acoustic compression wave which is propagated into the air.

The block labeled 104 will represent any process that changes or affects the audio signal or wave passing through the process. The audio passing through the process may either be an electronic audio signal or an acoustic compression wave. The process may either be a manufactured process, such as a signal processor or an emitter, or a natural process such as an air medium.

The block labeled 106 will represent the actual audible sound that results from an acoustic compression wave. Examples of audible sound may be the sound heard in the ear of a user, or the sound sensed by a microphone.

FIG. 1*b* is a flow diagram 110 of a conventional audio system. In a conventional audio system, an audio input signal 111 is supplied which is an electronic representation of the audio wave being reproduced. The audio input signal 111 may optionally pass through an audio signal processor 112. The audio signal processor is usually limited to linear processing, such as the amplification of certain frequencies and attenuation of others. Very rarely, the audio signal processor 112 may apply non-linear processing to the audio input signal 111 in order to adjust for non-linear distortion that may be directly introduced by the emitter 116. If the audio signal processor 112 is used, it produces an audio processed signal 114.

The audio processed signal 114 or the audio input signal 111 (if the audio signal processor 112 is not used) is then emitted from the emitter 116. As discussed in the section labeled 'related art', conventional sound systems typically employ dynamic speakers as their emitter source. Dynamic speakers are typically comprised of a simple combination of a magnet, voice coil and cone. The magnet and voice coil convert the variable voltage of the audio processed signal 114 to mechanical displacement, representing a first stage within the dynamic speaker as a conventional multistage transducer. The attached cone provides a second stage of impedance matching between the electrical transducer and air envelope surrounding the emitter 116, enabling transmission of small vibrations of the voice coil to emerge as expansive acoustic audio wave 118. The acoustic audio wave 118 proceeds to travel through the air 120, with the air substantially serving as a linear medium. Finally, the acoustic audio wave reaches the ear of a listener, who hears audible sound 122.

FIG. 1*c* is a flow diagram 130 that clearly highlights the complexity of a parametric sound system as compared to the conventional audio system of FIG. 1*b*. The parametric sound system also begins with an audio input signal 131. The audio input signal 131 may optionally pass through an audio signal processor 132. The audio signal processor in a parametric system commonly performs both linear and non-linear processing. It is known to practitioners of the parametric loudspeaker art that low frequencies of the audio input signal 131 will eventually be reproduced at a reduced level compared to the higher audio frequencies. This reduction in low frequency output causes a substantially 12 dB per octave slope with decreasing audio frequencies. It is well known to invoke linear pre-equalization to the audio input signal to compensate for this attribute of parametric loudspeakers. It is also known to perform nonlinear processing in the audio signal processor 132 such as a square rooting technique, where the audio input signal 131 is square rooted to compensate for the squaring effect that occurs as a parametric ultrasonic wave 148 (described in detail below) decouples in air 150 to form a decoupled audio wave 152. If the audio signal processor 132 is used, it produces an audio processed signal 134.

The audio processed signal 134 or the audio input signal 131 (if the audio signal processor 132 is not used) is then parametrically modulated with an ultrasonic carrier signal 136 using a parametric modulator 138. The ultrasonic carrier signal 136 may be supplied by any ultrasonic signal source. While the ultrasonic carrier signal 136 is normally fixed at a constant ultrasonic frequency, it is possible to have an ultrasonic carrier signal that varies in frequency. The parametric modulator 138 is configured to produce a parametric ultrasonic signal 140, which is comprised of an ultrasonic carrier signal, which is normally fixed at a constant frequency, and at least one sideband signal, wherein the sideband signal frequencies vary such that the difference between the sideband signal frequencies and the ultrasonic carrier signal frequency are the same frequency as the audio input signal 131. The parametric modulator 138 may be configured to produce a parametric ultrasonic signal 140 that either contains one sideband signal (single sideband modulation, or SSB), or both upper and lower sidebands (double sideband modulation, or DSB).

Normally, the parametric ultrasonic signal 140 is then emitted from the emitter 146, producing a parametric ultrasonic wave 148 which is propagated into the air 150. The parametric ultrasonic wave 148 is comprised of an ultrasonic carrier wave and at least one sideband wave. The parametric ultrasonic wave 148 drives the air into a substantially non-linear state. Because the air serves as a non-linear medium, acoustic heterodyning occurs on the parametric ultrasonic wave 148, causing the ultrasonic carrier wave and the at least one sideband wave to decouple in air, producing a decoupled audio wave 152 whose frequency is the difference between the ultrasonic carrier wave frequency and the sideband wave frequencies. Finally, the decoupled audio wave 152 reaches the ear of a listener, who hears audible sound 154. The end goal of parametric audio systems is for the decoupled audio wave 152 to closely correspond to the original audio input signal 131, such that the audible sound 154 is 'pure sound', or the exact representation of the audio input signal. However, because of limitations in parametric loudspeaker technology, including an inability to eliminate non-linear distortion from being introduced into the decoupled audio wave 152, attempts to produce 'pure sound' with parametric loudspeakers have been largely unsuccessful. The above process describing parametric audio systems is thus far substantially known in the prior art.

The present invention introduces the additional steps of a parametric ultrasonic signal processor 142 that produces a parametric ultrasonic processed signal 144, indicated generally by the dotted box 141. Specifically, the present invention introduces a parametric ultrasonic signal processor 142 which is able to compensate for the linear response of the acoustical output of an emitter, in order to produce a decoupled audio wave 152 and audible sound 154 that more closely correspond to the audio input signal 131.

For the purposes of this disclosure, the linear response of the acoustical output of an emitter is a function of at least physical characteristics of the electro-acoustical emitter 146 and an environmental medium wherein the parametric ultrasonic wave 148 is propagated. The physical characteristics of the electro-acoustical emitter 146 may include an asymmetric frequency response. Environmental medium effects may include asymmetry that is developed or increased in the parametric ultrasonic wave 148 due to propagation absorption in the air medium that can cause greater attenuation at higher ultrasonic frequencies than at lower ultrasonic frequencies. In the case of environmental medium effects, even where an ideal emitter with zero linear errors is used, an asymmetry in the parametric ultrasonic wave 148 frequency response can develop with distance from the emitter itself, thereby causing distortion in the decoupled audio wave, and altering the audible sound heard by the listener.

The inventor of this application has discovered that a significant portion of the distortion plaguing the decoupled audio waves 152 of parametric speakers is caused by a characteristic of parametric loudspeakers such that linear errors in the parametric ultrasonic waves 148 output from an electro-acoustical emitter can result in NON-linear errors in the decoupled audio waves 152. This behavior is quite different from what is found in conventional loudspeakers, where linear errors in the acoustic output of an electro-acoustical emitter only result in similar linear errors in the audible waves.

For example, if an acoustic audio wave 118 (FIG. 1*b*) were emitted from an emitter 116 having a frequency response that is non-flat (a linear error), the audible sound 122 would merely have some frequencies that are more amplified than others (a similar linear error). However, if a parametric ultrasonic signal 140 (FIG. 1*c*) is emitted from an emitter 146 having a frequency response that is non-flat and asymmetrical above and below the resonant frequency in the ultrasonic frequency range of interest (a linear error), the decoupled audio wave 152 that results from the decoupling of the parametric ultrasonic wave 148 within air 150 will possess increased non-linear distortion (a non-linear error).

Figure 2A:
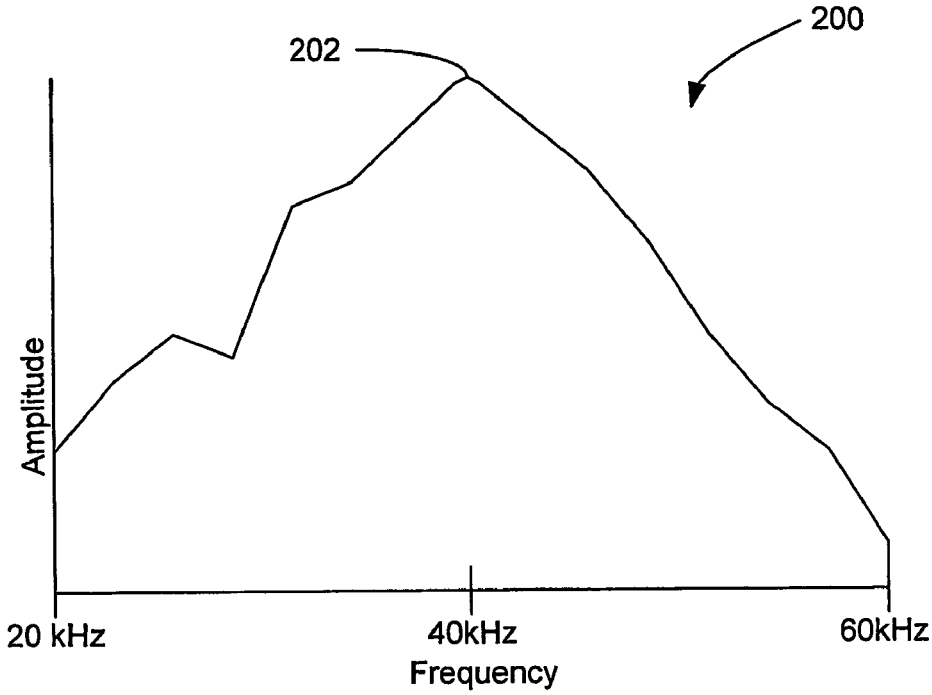
FIG. 2*a* is a plot showing the frequency response of a typical electro-acoustical emitter for the frequencies used to produce an ultrasonic parametric output.
Figure 2B:
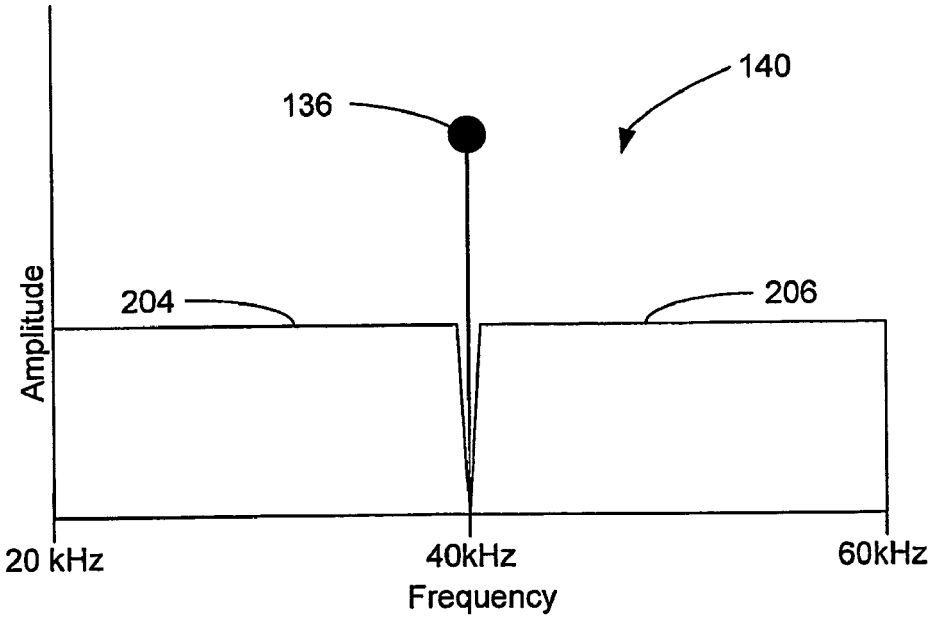
FIG. 2*b* is a frequency vs. amplitude plot of a parametric signal to be emitted from the electro-acoustical emitter in FIG. 2*a*.
Figure 3:
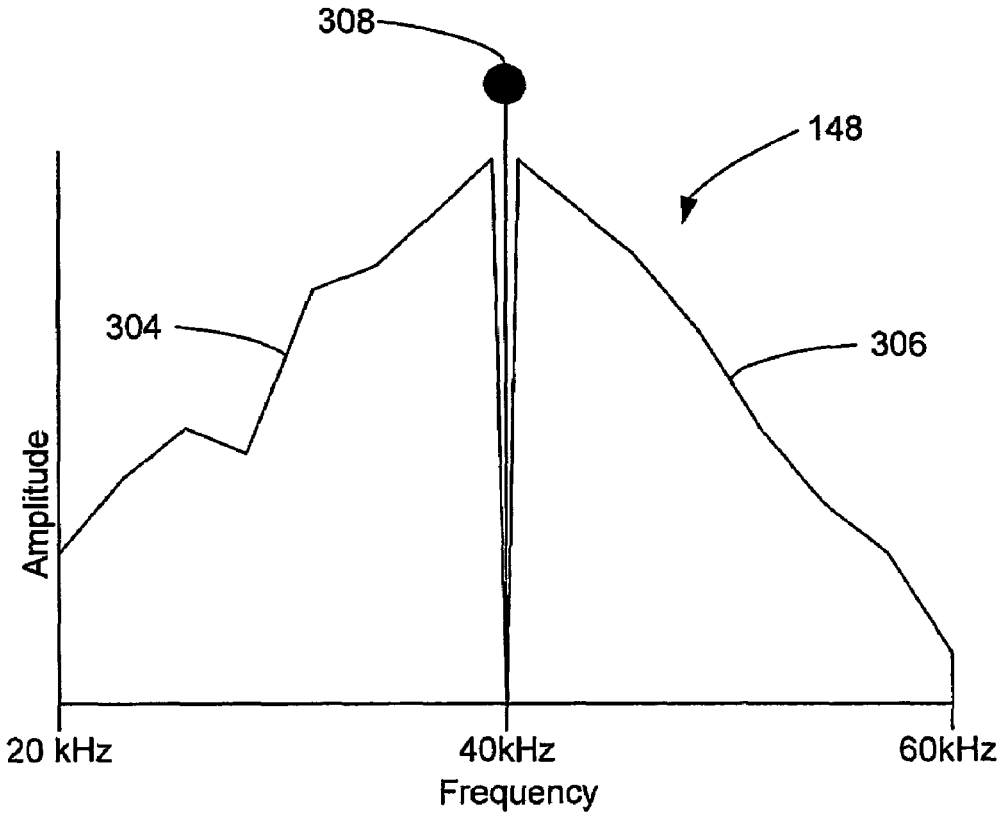
FIG. 3 (Prior Art)
FIG. 3 is a frequency vs. amplitude plot of the ultrasonic parametric acoustic output that results from emitting the parametric signal in FIG. 2 from the electro-acoustical emitter in FIG. 2*a*, as performed in the prior art.

FIGS. 2*a*, 2*b*, and 3 display an example of the effects an emitter with an imperfect, asymmetrical frequency response can have on a parametric signal as it is emitted from the emitter. FIG. 2*a* is a plot of the frequency response 200 of a typical electro-acoustical emitter for the frequencies used to produce ultrasonic parametric waves. For the purpose of simplicity, the following examples focus only on the frequency response 200 of the emitter. However, it is to be remembered that the frequency response may also include the entire linear response of the acoustical output of an emitter, including environmental medium effects. The frequency response 200 has a resonance frequency 202 at 40 kHz, which may also be the frequency of the ultrasonic carrier signal. When a parametric ultrasonic signal is sent to the emitter represented in FIG. 2*a*, the emitter attenuates the amplitudes of the frequencies on each side of the resonance frequency, most likely attenuating the sideband frequencies of a parametric ultrasonic signal. In this example, the emitter attenuates the higher frequencies at a faster rate than it attenuates the lower frequencies, and has other asymmetries such as the incongruous attenuation taking place at approximately 38 kHz. The frequency response also has a curve shape such that the audio frequencies represented in the sideband falling above the resonance frequency is different as compared to those below the resonance frequency. The frequency response shown in FIG. 2*a* is actually not far from the actual frequency responses of many emitters used in parametric sound systems.

FIG. 2*b* is a plot of a parametric ultrasonic signal 140 (see also FIG. 1*c*) with an upper sideband 206, a lower sideband 204, and an ultrasonic carrier signal 136. The upper 206 and lower 204 sidebands are displayed as relatively flat, to portray the idea that when a parametric modulator 138 (FIG. 1*c*) creates the parametric ultrasonic signal 140, no frequencies of the parametric ultrasonic signal 140 are amplified more than others. When the parametric ultrasonic signal 140 in FIG. 2*b* is emitted from the emitter with the frequency response of FIG. 2*a*, the parametric ultrasonic wave 148 of FIG. 3 results having asymmetric sidebands 306 and 304 (see also 148 in FIG. 1*c*). The asymmetric sidebands 306 and 304 are caused by the non-flat, asymmetric frequency response of FIG. 2*a*. While this result is a linear error, a distorted, non-linear error may result when the parametric ultrasonic wave 148 represented in FIG. 3 decouples in air 150 to produce a decoupled audio wave 152 (see FIG. 1*c*). Additionally, said linear errors in the parametric ultrasonic wave 148 result in lower output levels in the decoupled audio wave 152.

Historically, designers of parametric loudspeakers have made the assumption of a flat linear response for the acoustic output of electro-acoustical emitter, largely ignoring the fact that virtually no emitter has a perfectly flat linear response in the ultrasonic frequency range of interest, and largely ignoring the effects an environmental medium can have on a parametric ultrasonic wave 148. This assumption is an oversimplification, and usually comes at the expense of non-linear distortion and compromised efficiency in the decoupled audio wave 152. Even the known audio signal processing techniques such as the square root preprocessing discussed above or other distortion reduction means become largely ineffective, because they have been discovered to depend on minimal linear errors, or minimum asymmetry, in the parametric ultrasonic wave 148 to be effective. It has been found by the inventor that because parametric loudspeaker theory has not been expanded to include real world parametric emitters with substantial linear and asymmetric errors, the application of prior art parametric theory to prior art parametric loudspeakers continues to deliver audio output with substantially greater distortion and lower output levels than conventional loudspeakers. By matching the sidebands and/or flattening the linear response of the output of an emitter, as disclosed in the present invention, other distortion correction techniques become much more effective.

Linear emitter response errors also may detrimentally affect the modulation index of a parametric system. As those familiar with the parametric art know, modulation index relates to the ratio of the ultrasonic carrier signal or wave level to the sideband signal or wave levels. A modulation index of 1 means that the ultrasonic carrier amplitude is equal to the sideband amplitude in SSB signals/waves, or the sum of the upper sideband amplitude and the lower sideband amplitude in DSB signals/waves. A modulation index of 1 is optimal for maximum conversion efficiency.

Similar to the above-described issue, designers of parametric loudspeakers have usually assumed that the modulation index of the parametric ultrasonic signal 140 (the 'electrical modulation index') must be optimized. Again, designers of parametric loudspeakers largely ignored the effects that the linear response of the acoustical output of an emitter may have on the modulation index of the parametric ultrasonic wave 148 (or 'acoustic modulation index'). However, it is the acoustic modulation index of the parametric ultrasonic wave 148 that determines the conversion efficiency when the parametric ultrasonic wave 148 decouples in air 150 to form the decoupled audio wave 152. As can be seen by the response curves of FIGS. 2*a*, 2*b* and 3, if the carrier is placed at or near the resonant frequency 202 then all sideband frequencies divergent from the resonant frequency 202 will be reproduced at reduced output. Therefore, if the desired, target modulation index is one, and the electrical modulation index is set to one, the resultant acoustical modulation index will always be somewhat less than the target modulation index because the sidebands will have reduced output. This unintended reduction in modulation index, regardless of the target index value, causes reduced conversion efficiency and therefore reduced sound pressure level in the decoupled audio wave 152 of prior art parametric loudspeakers.

Because the linear response of the acoustical output of emitters will virtually always possess asymmetries and other linear errors, the inventor of the present invention found it necessary to develop a method to compensate for these imperfections so that the decoupled audio wave 152 would more closely correspond to the audio input signal 131.

Figure 4:
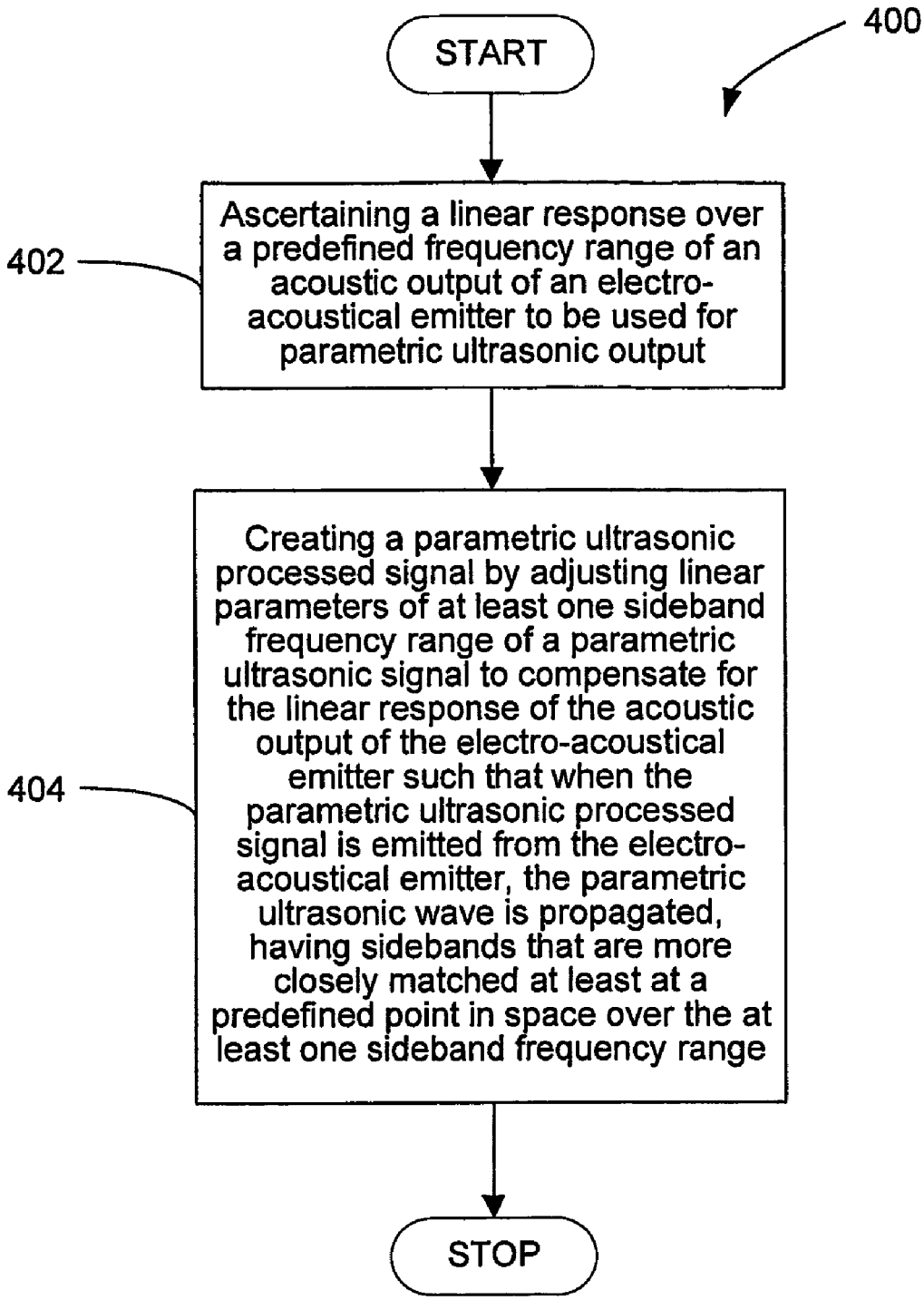
FIG. 4 is a flow diagram illustrating a method used to attain a parametric ultrasonic output wave having closely matched sidebands, in accordance with an embodiment of the present invention.

As illustrated in FIG. 4, a method 400, in accordance with the present invention, is shown for producing a parametric ultrasonic wave to be decoupled in air to create a decoupled audio wave that closely corresponds to an audio input signal. The method may include ascertaining 402 a linear response over a predefined frequency range of an acoustic output of an electro-acoustical emitter to be used for parametric ultrasonic output. The method may further include creating 404 a parametric ultrasonic processed signal by adjusting linear parameters of at least one sideband frequency range of a parametric ultrasonic signal to compensate for the linear response of the acoustic output of the electro-acoustical emitter such that when the parametric ultrasonic processed signal is emitted from the electro-acoustical emitter, the parametric ultrasonic wave is propagated, having sidebands that are more closely matched at least at a predefined point in space over the at least one sideband frequency range.

As previously discussed, nearly all electro-acoustical emitters have a linear response that is non-flat. Often, emitters are purposely designed to have a high Q so that the emitter can operate efficiently at the resonance frequency, while attenuating the frequencies displaced from the resonant frequency. This attenuation often causes the upper sideband to be mismatched when compared to the lower sideband. Under method 400, the linear parameters of the parametric ultrasonic signal are adjusted such that when the parametric ultrasonic wave is propagated, the sidebands are more closely matched to one another-meaning that the upper sideband matches the lower sideband more closely than it would have had no adjustment were made to the linear parameters of the parametric ultrasonic signal. Method 400 is meant to extend to any adjustment made to the parametric ultrasonic signal so that the propagated parametric ultrasonic wave will possess sidebands that are more closely matched than they otherwise would have been.

Figure 5A:
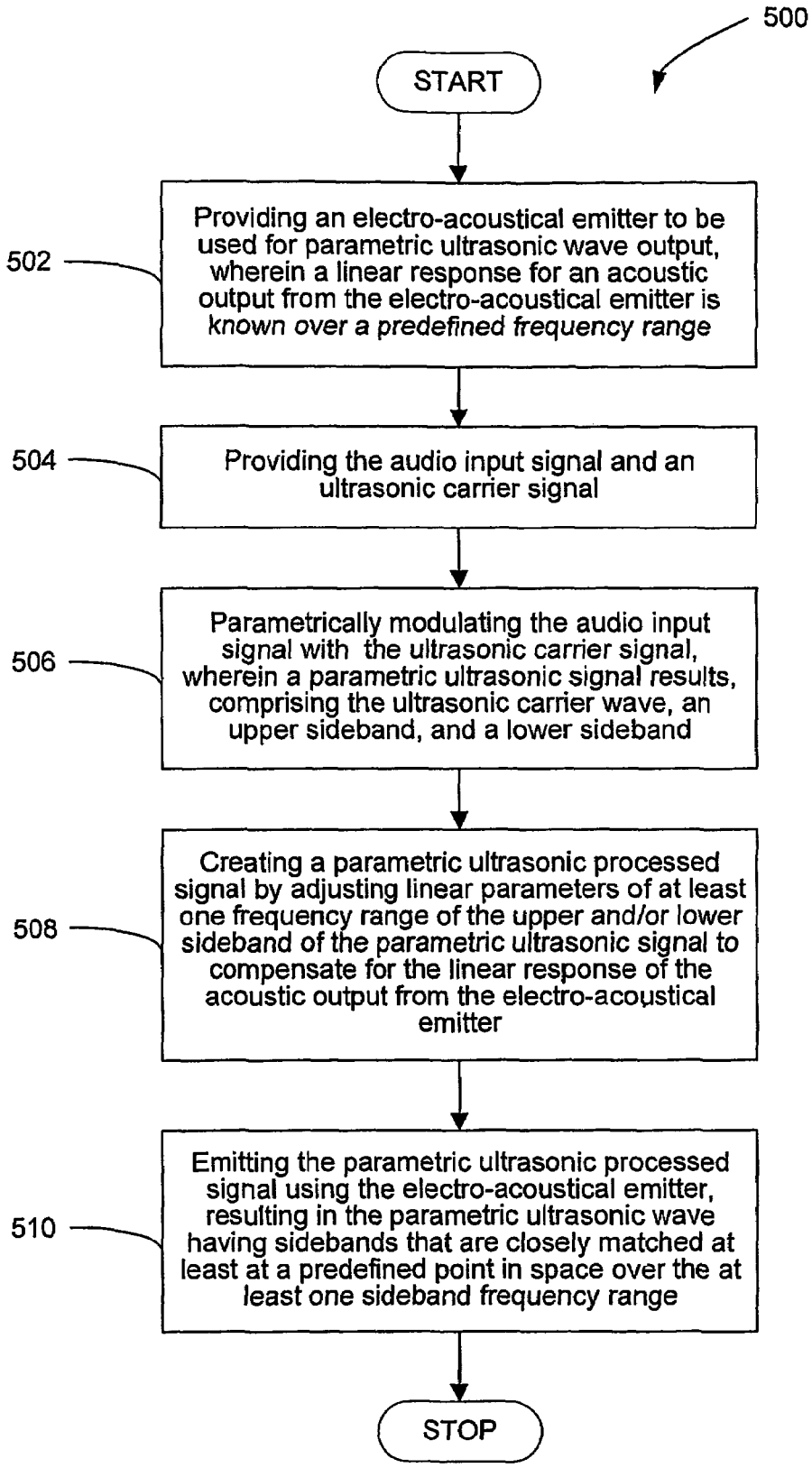
FIG. 5*a* is a flow diagram illustrating a more detailed method used to attain a parametric ultrasonic output wave having closely matched sidebands, in accordance with an embodiment of the present invention.

FIG. 5*a* illustrates a more detailed method 500, in accordance with the present invention, for producing a parametric ultrasonic wave to be decoupled in air to create a decoupled audio wave that closely corresponds to an audio input signal. The method may include providing 502 an electro-acoustical emitter to be used for parametric ultrasonic wave output, wherein a linear response for an acoustic output from the electro-acoustical emitter is known over a predefined frequency range. The method may further include providing 504 the audio input signal and an ultrasonic carrier signal. The method may further include parametrically modulating 506 the audio input signal with the ultrasonic carrier signal, wherein a parametric ultrasonic signal results, comprising the ultrasonic carrier wave, an upper sideband, and a lower sideband. The method may further include creating 508 a parametric ultrasonic processed signal by adjusting linear parameters of at least one frequency range of the upper and/or lower sideband of the parametric ultrasonic signal to compensate for the linear response of the acoustic output from the electro-acoustical emitter. The method may further include emitting 510 the parametric ultrasonic processed signal using the electro-acoustical emitter, resulting in the parametric ultrasonic wave having sidebands that are more closely matched at least at a predefined point in space over the at least one sideband frequency range.

Figure 5B:
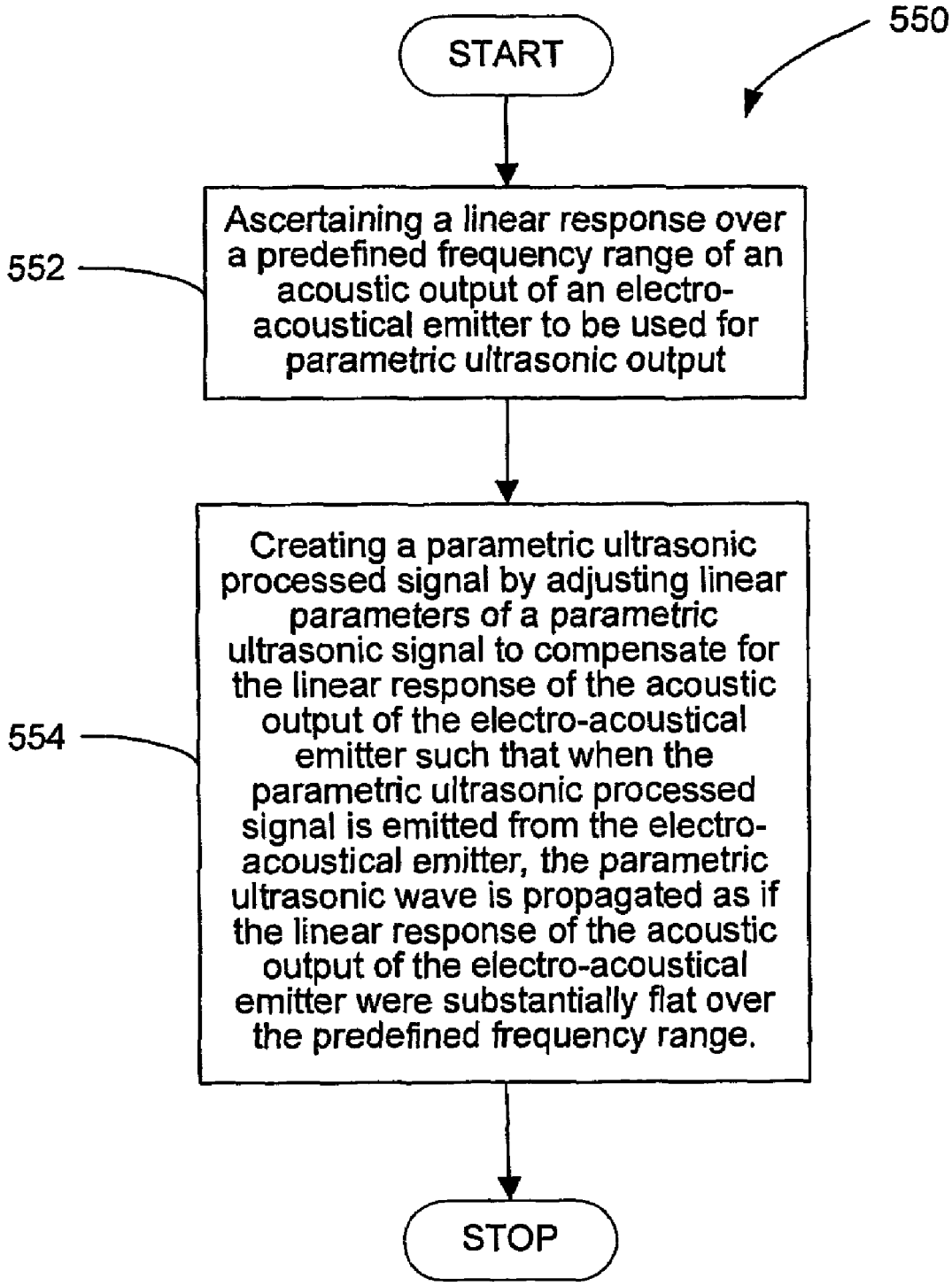
FIG. 5*b* is a flow diagram illustrating a method for attaining an a parametric ultrasonic output wave having a linear response that is substantially flat.

FIG. 5*b*. illustrates a method 550, in accordance with the present invention, for producing a parametric ultrasonic wave to be decoupled in air to create a decoupled audio wave that closely corresponds to an audio input signal. The method may include ascertaining 552 a linear response over a predefined frequency range of an acoustic output of an electro-acoustical emitter to be used for parametric ultrasonic output. The method may further include creating 554 a parametric ultrasonic processed signal by adjusting linear parameters of a parametric ultrasonic signal to compensate for the linear response of the acoustic output of the electro-acoustical emitter such that when the parametric ultrasonic processed signal is emitted from the electro-acoustical emitter, the parametric ultrasonic wave is propagated as if the linear response of the acoustic output of the electro-acoustical emitter were substantially flat over the predefined frequency range.

In the context of the present invention, "substantially flat" is defined as producing the effect that the linear response of the acoustic output is at least more flat that if the parametric ultrasonic signal were emitted without having been adjusted at all. Preferably, the method 550 produces the effect that all amplitudes of the linear response within frequency range of interest were within 5 dB of one another.

The linear parameters of the above methods may include at least amplitude, directivity, time delay, and phase.

In accordance with the present invention, FIGS. 1, 2, and 6-9 provide plots to demonstrate the process through which the methods illustrated in FIGS. 4 and 5 produce a parametric ultrasonic wave to be decoupled in air to create a decoupled audio wave that closely corresponds to an audio input signal. FIG. 2*a* is an example of a frequency response 200 for an electro-acoustical emitter over a predefined frequency range to be used for parametric output. For the purpose of simplicity, the following examples focus only on the frequency response 200 of the emitter. However, it is to be remembered that the frequency response may also include the entire linear response of the acoustical output of an emitter, including environmental medium effects. The frequency response 200 has a resonance frequency 202 at 40 kHz, which may also be the frequency of the ultrasonic carrier signal. The emitter attenuates the frequencies above and below the resonance frequency. Notably, this emitter, like many others, attenuates the frequencies above the resonance frequency at a slightly higher rate than the frequencies below the resonance frequency, and has other asymmetries such as the incongruous attenuation taking place at approximately 38 kHz.

FIG. 2*b* is an example of a parametric ultrasonic signal 140 (see also FIG. 1*c*) with an upper sideband 206, a lower sideband 204, and an ultrasonic carrier signal 136, resultant from the parametric modulation of the audio input signal 131 and an ultrasonic carrier signal 136 (also see FIG. 1*c*). The ultrasonic carrier signal 136 frequency has purposely been set at 40 kHz, the same frequency as the resonance frequency 202 of the emitter, to maximize the efficiency of the emitter. However, it is not necessary that the ultrasonic carrier signal be at the same frequency as the resonance frequency of the emitter.

Figure 6:
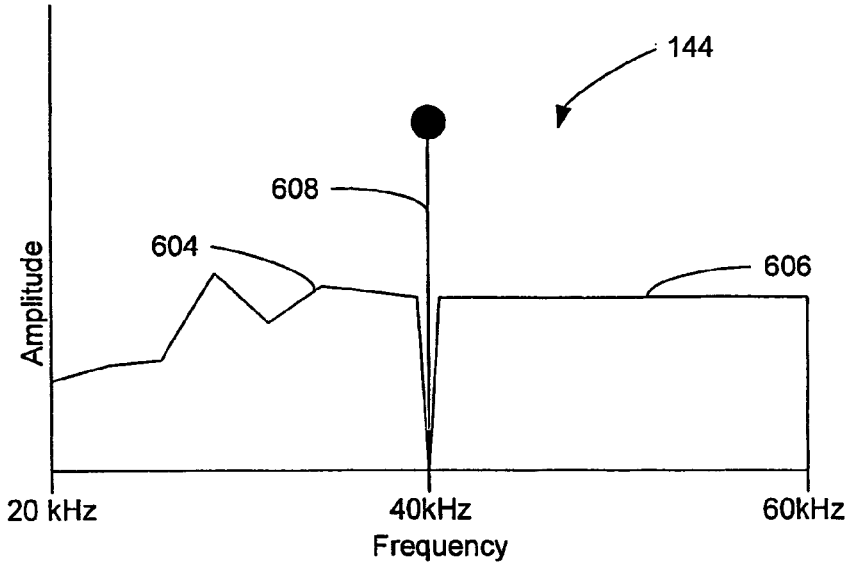
FIG. 6 is a frequency vs. amplitude plot of a parametric signal that has been modified such that the acoustic parametric output will have sidebands that are closely matched, in accordance with an embodiment of the present invention.

FIG. 6 is an example of a parametric ultrasonic processed signal 144 (See also FIG. 1*c*) created by adjusting the linear parameters of the lower sideband 204 of the parametric ultrasonic signal 140 shown in FIG. 2*b* to compensate for the asymmetric frequency response of the electro-acoustical emitter shown in FIG. 2*a*. The parametric ultrasonic processed signal 144 is comprised of an ultrasonic carrier signal 608, an upper sideband 606 and a lower sideband 604. Because the frequency response 200 of the emitter in FIG. 2*a* has already been ascertained, a prediction can be made as to how much to adjust the upper and/or lower sideband frequencies so that when the parametric ultrasonic processed signal 144 is emitted through the emitter of FIG. 2*a*, the resultant parametric ultrasonic wave 148 (See FIGS. 1*c* and 7) will have sidebands 704 and 706 FIG. 7) that are closely matched. While this particular example adjusted the amplitudes of the lower sideband of the parametric ultrasonic signal 140, it is to be understood that increasing or decreasing the amplitudes of the upper sideband, the lower sideband, or both sidebands to obtain similar results is within the scope of the present invention.

Figure 7:
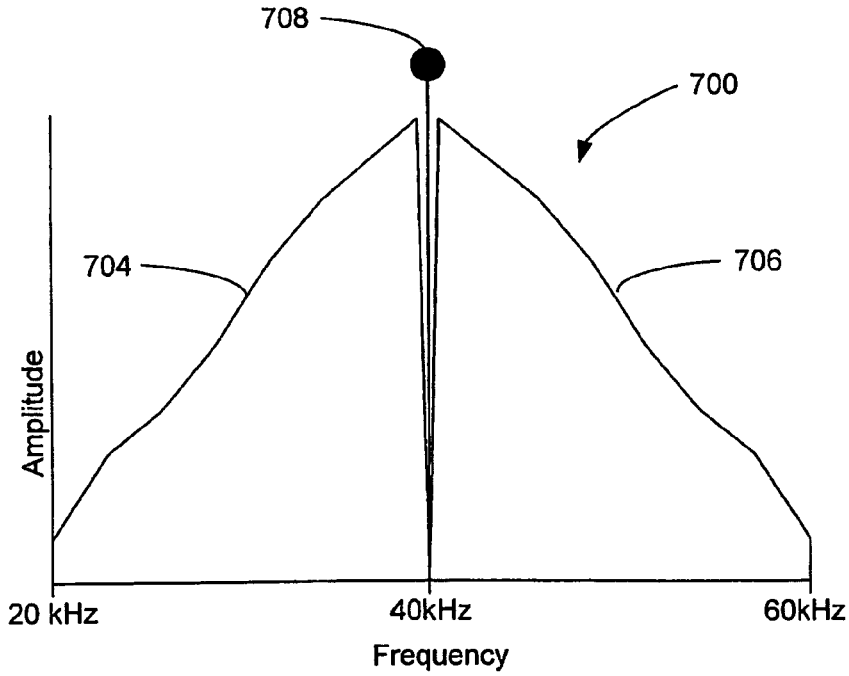
FIG. 7 is a frequency vs. amplitude plot of the acoustic parametric output that results from emitting the modified parametric signal from FIG. 6 from the electro-acoustical emitter in FIG. 2*a*.

FIG. 7 is an example of the parametric ultrasonic wave 148 (See also FIG. 1*c*) that results when the parametric ultrasonic processed signal 144 of FIG. 6 is emitted from the emitter described in FIG. 2A. While the plot in FIG. 7 does not exactly match the original plot in FIG. 2*b*, the technique of adjusting linear parameters performed in FIG. 6 has produced sidebands 706 and 704 that are closely matched. This is an improvement over the prior art example in FIG. 3, where the parametric ultrasonic wave 148 had sidebands 306 and 304 that were not closely matched. The adjusting of linear parameters performed in FIG. 6, producing the parametric ultrasonic processed signal 144, has the effect of creating an emitter whose frequency response is closely symmetric around the resonant frequency.

Figure 8:
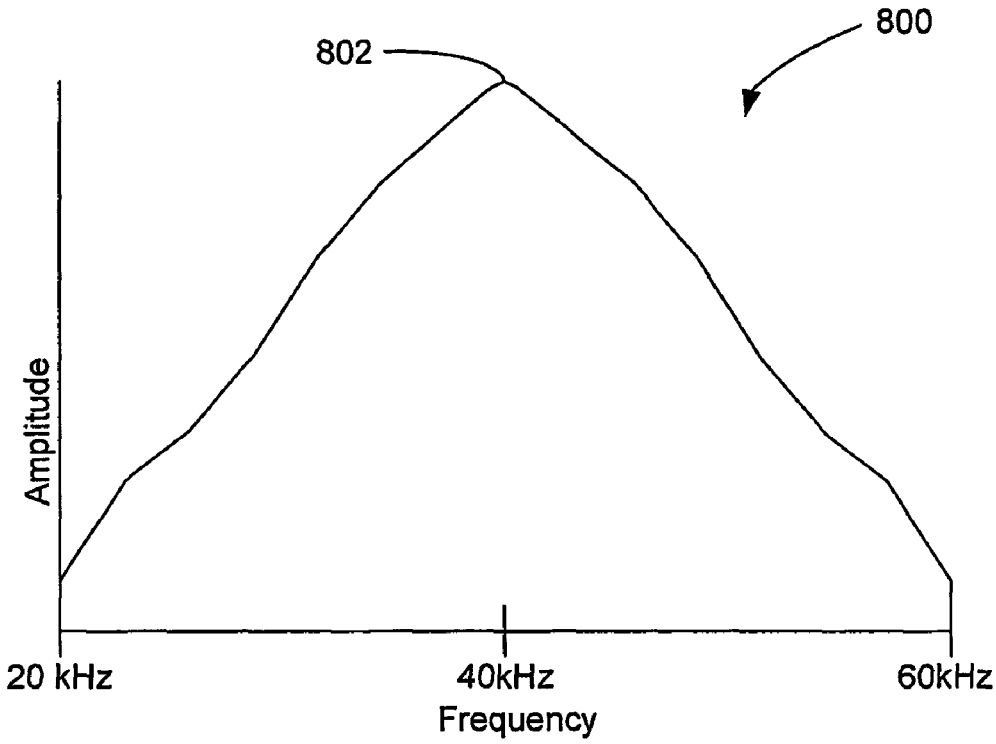
FIG. 8 is the frequency response of the emitter that is essentially created after the adjusting of linear parameters has been performed to balance the sidebands.

FIG. 8 is a representation of the resultant frequency response 800 of the emitter. Keep in mind that the actual frequency response of the emitter is still that of FIG. 2A. However, the technique of adjusting linear parameters employed above has created the effect that the frequency response is balanced around the resonant frequency 802.

Figure 9:
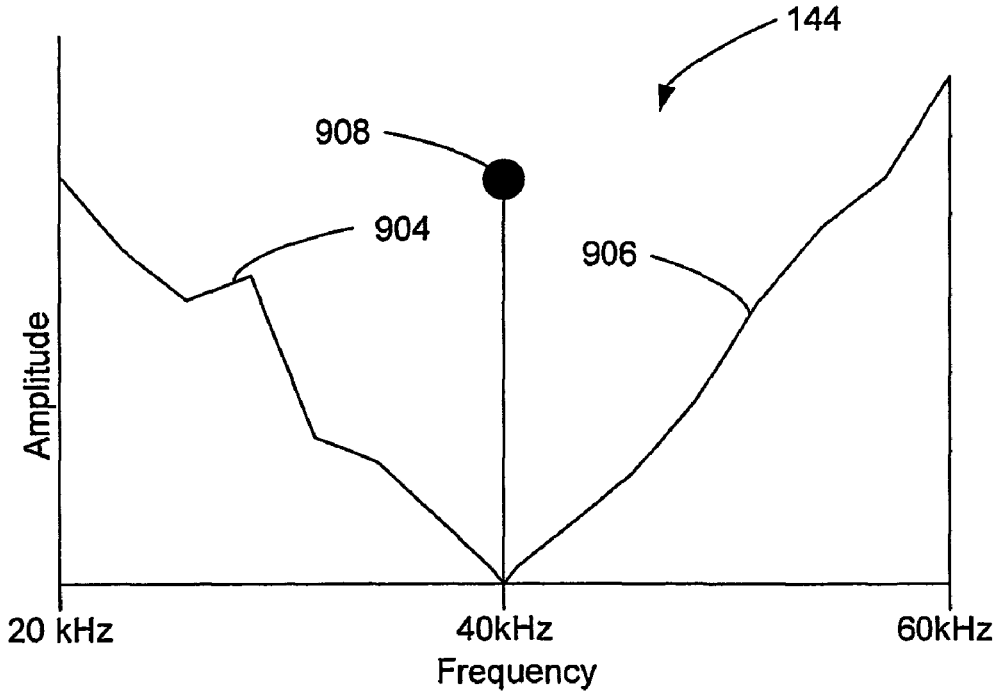
FIG. 9 is a frequency vs. amplitude plot of a parametric signal that has been further modified so as to generate the effect that the frequency response of the electro-acoustical emitter is approximately flat, in accordance with an embodiment of the present invention.

Once the parametric ultrasonic signal 140 has been modified so that the resultant parametric ultrasonic wave 148 has closely matched sidebands as shown in FIGS. 6 and 7, the parametric ultrasonic processed signal 144 of FIG. 6 may be further modified to produce even more desirable results. FIG. 9 shows the parametric ultrasonic processed signal 144 of FIG. 6 that has been further modified such that the resultant parametric ultrasonic wave 148 will not only have sidebands that closely match each other, but will also have sidebands that closely match the original parametric ultrasonic signal 140 of FIG. 2*b*. In this example, the amplitudes of the extremities of both the upper and lower sidebands 906 and 904 have been increased. In another embodiment, frequencies closer to the ultrasonic carrier signal 908 frequency may be suppressed, and similar results would have been obtained.

Figure 10:
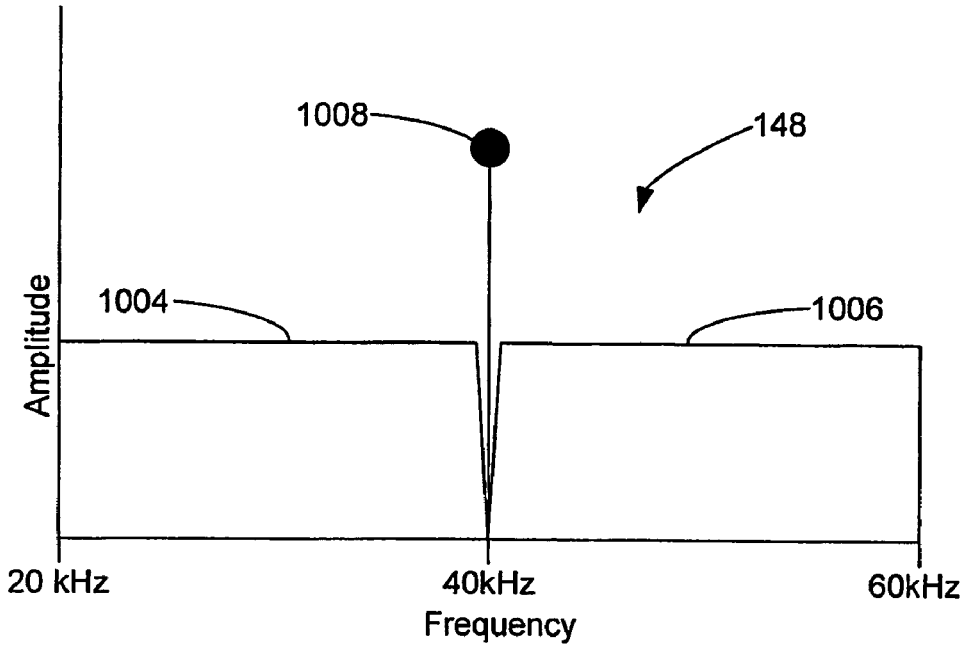
FIG. 10 is a frequency vs. amplitude plot of the parametric acoustic output that results from emitting the modified parametric signal from FIG. 9 from the electro-acoustical emitter in FIG. 2*a*, which generates the effect that the frequency response of the electro-acoustical emitter is approximately flat, in accordance with an embodiment of the present invention.

FIG. 10 shows the resultant parametric ultrasonic wave 148 (See also FIG. 1*c*) after the adjusting of linear parameters is performed in FIGS. 6 and 9. Notably, the frequency vs. amplitude plot of the parametric ultrasonic wave 148 in FIG. 10 closely matches the frequency vs. amplitude plot of the original parametric ultrasonic signal 140 in FIG. 2*b*.

Figure 11:
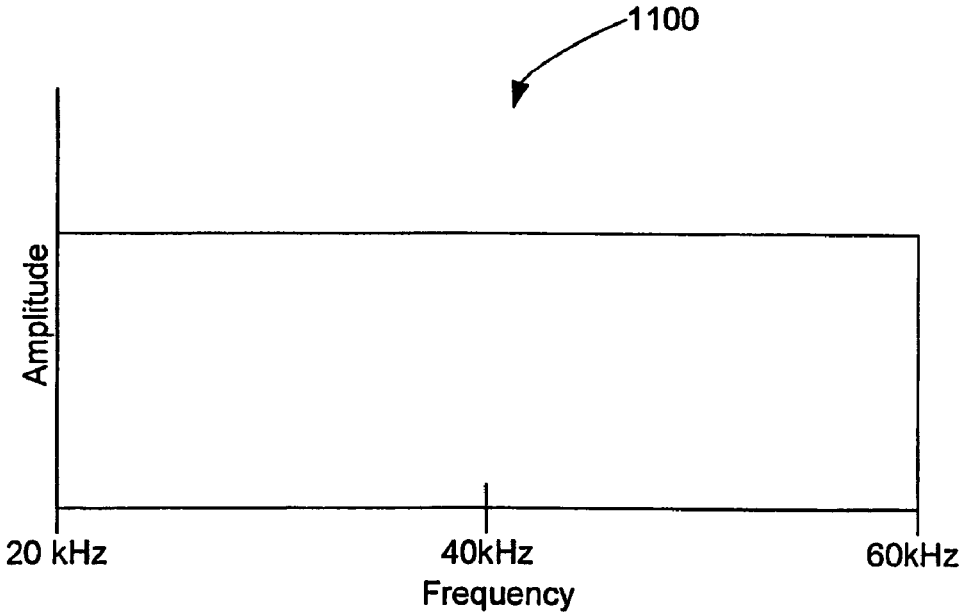
FIG. 11 is the frequency response of the emitter that is essentially created after the adjusting of linear parameters has been performed to flatten the overall frequency response.

The adjusting of linear parameters performed above, producing the parametric ultrasonic processed signal 144 of FIG. 9, has the effect of creating an emitter whose frequency response is approximately flat, or at least more flat than the response would have been had the methods disclosed in the invention not been employed. FIG. 11 is a representation of the resultant frequency response 1100 of the emitter. Keep in mind that the actual frequency response of the emitter is still that of FIG. 2*a*. However, the technique of adjusting linear parameters employed above has created the effect that the frequency response 1100 is approximately flat. Thus, the linear errors produced by the emitter have been substantially eliminated, thereby eliminating the non-linear distortion produced when the parametric ultrasonic wave 148 decouples in air (serving as a non-linear medium) 150 to produce the decoupled audio wave 152. Again, although in this example, the adjusting of linear parameters only compensated for imperfections in the frequency response of the emitter, the adjusting of linear parameters could have also taken into account the entire linear response of the acoustic output from the electro- acoustical emitter, including various environmental medium effects.

The process of balancing the sidebands and flattening the overall response may either be performed in two distinct steps as demonstrated here, or may be combined into one step.

In the above example, the linear parameters of the parametric ultrasonic signal 140 were altered such that the sideband frequency range corresponding to substantially all of the sonic frequency range would be matched. These frequencies approximately correspond to the decoupled audio wave 152 (FIG. 1*c*) frequency range from 15 Hz to 20 kHz. In another embodiment, a much smaller sideband frequency range may be altered. For example, the altered sideband frequency range may only correspond to a 3 kHz bandwidth or less in the decoupled audio wave 152 frequency range. Altering any range of frequencies in accordance with the subject matter disclosed here is within the scope of the present invention.

Various types of filtering techniques may produce the modified parametric signals discussed above. Examples of such filtering techniques include, but are not limited to, analog filters and various digital signal processing techniques.

Filtering may be performed on the parametric signal such that the resultant sidebands will be matched on a linear frequency scale as opposed to a logarithmic frequency scale. One skilled in the art will appreciate that electronic filters attenuate frequencies outside the passband region at a certain rate per octave or decade. Each octave represents a doubling in frequency, and each decade represents a factor of ten, both creating logarithmic frequency scales. The rate of filtering is usually measured in dB/octave or dB/decade. While filtering parametric ultrasonic signals in accordance with the present invention, it may be beneficial to recognize that while a frequency range may represent an octave in the decoupled audio wave 152 frequency range, the same frequency range would not represent an octave in the parametric ultrasonic signal 140 frequency range. For example, if a parametric ultrasonic signal consisted of an ultrasonic carrier signal frequency set at 40 kHz, and modulated sideband frequencies ranging from 41 kHz to 42 kHz and from 38 kHz to 39 kHz (for DSB modulation), the decoupled audio output would range from 1 kHz to 2 kHz. While the difference between 1 kHz and 2 kHz is an entire octave, the difference between 41 kHz and 42 kHz is only a small portion of an octave. To further complicate the matter, the difference between 38 kHz and 39 kHz is a different portion of an octave than the range from 41 kHz to 42 kHz. These differences may be taken into account when filtering the parametric signal, so as to match the resultant sidebands on a linear frequency scale as opposed to a logarithmic frequency scale.

As previously mentioned, and in one embodiment of the invention, the linear response of the acoustic output from the electro-acoustical emitter may further include environmental medium effects. Environmental medium effects are dependent on many variables, and may differ in each environmental setting. Examples of environmental medium effects may include humidity, temperature, air saturation, and natural absorption. Acoustic medium effects such as these may attenuate different frequencies at different rates. Consequently, and by way of example, if a listener were positioned at 10 ft. from the emitter structure, the environmental medium effects may attenuate the upper sideband of the parametric ultrasonic wave 148 at a higher rate than the lower sideband, creating an asymmetry between the upper and lower sidebands at the position of the listener. Therefore, when the parametric ultrasonic wave 148 decouples at the position of the listener, the resultant decoupled audio wave 150 may contain nonlinear distortion, and therefore would not hear "pure sound." In accordance with one embodiment of the present invention, the amplitudes of the parametric signal may be further altered to compensate for the environmental medium effects so that the decoupled audio wave 150 will more closely represent "pure sound", having minimal nonlinear distortion. Therefore, the parametric ultrasonic wave 148 would be propagated, having sidebands that are closely matched at a predefined point in space, where the point in space is the location of a listener. If no environmental medium effects were taken into account, the parametric ultrasonic wave 148 would still be propagated having sidebands that were closely matched at a predefined point in space, the point in space being the face of the emitter structure.

When acoustic heterodyning occurs, the frequencies closest to the carrier signal frequency, which represent the lowest decoupled audio frequencies, are decoupled at a more attenuated level than those frequencies further away from the carrier frequency. The rate at which the frequencies closer to the carrier frequency are attenuated upon decoupling is 12 dB/octave. One embodiment of the present invention compensates for the 12 dB/octave attenuation by pre-equalizing either the audio input signal or the parametric ultrasonic signal.

In one embodiment, the electro-acoustical emitter provided in the above methods may include a film emitter diaphragm. As disclosed in the section labeled 'Related Art', the present inventor and his associates have discovered that the use of a film emitter diaphragm in parametric loudspeakers provides numerous benefits over conventional speakers. Various types of film may be used as the emitter film. The important criteria are that the film be capable of (i) deforming into arcuate emitter sections at cavity locations, and (ii) responding to an applied electrical signal to constrict and extend in a manner that reproduces an acoustic output corresponding to the signal content. Although piezoelectric materials are the primary materials that supply these design elements, new polymers are being developed that are technically not piezoelectric in nature. Nevertheless, the polymers are electrically sensitive and mechanically responsive in a manner similar to the traditional piezoelectric compositions. Accordingly, it should be understood that reference to films in this application is intended to extend to any suitable film that is both electrically sensitive and mechanically responsive (ESMR) so that acoustic waves can be realized in the subject transducer.

Figure 12:
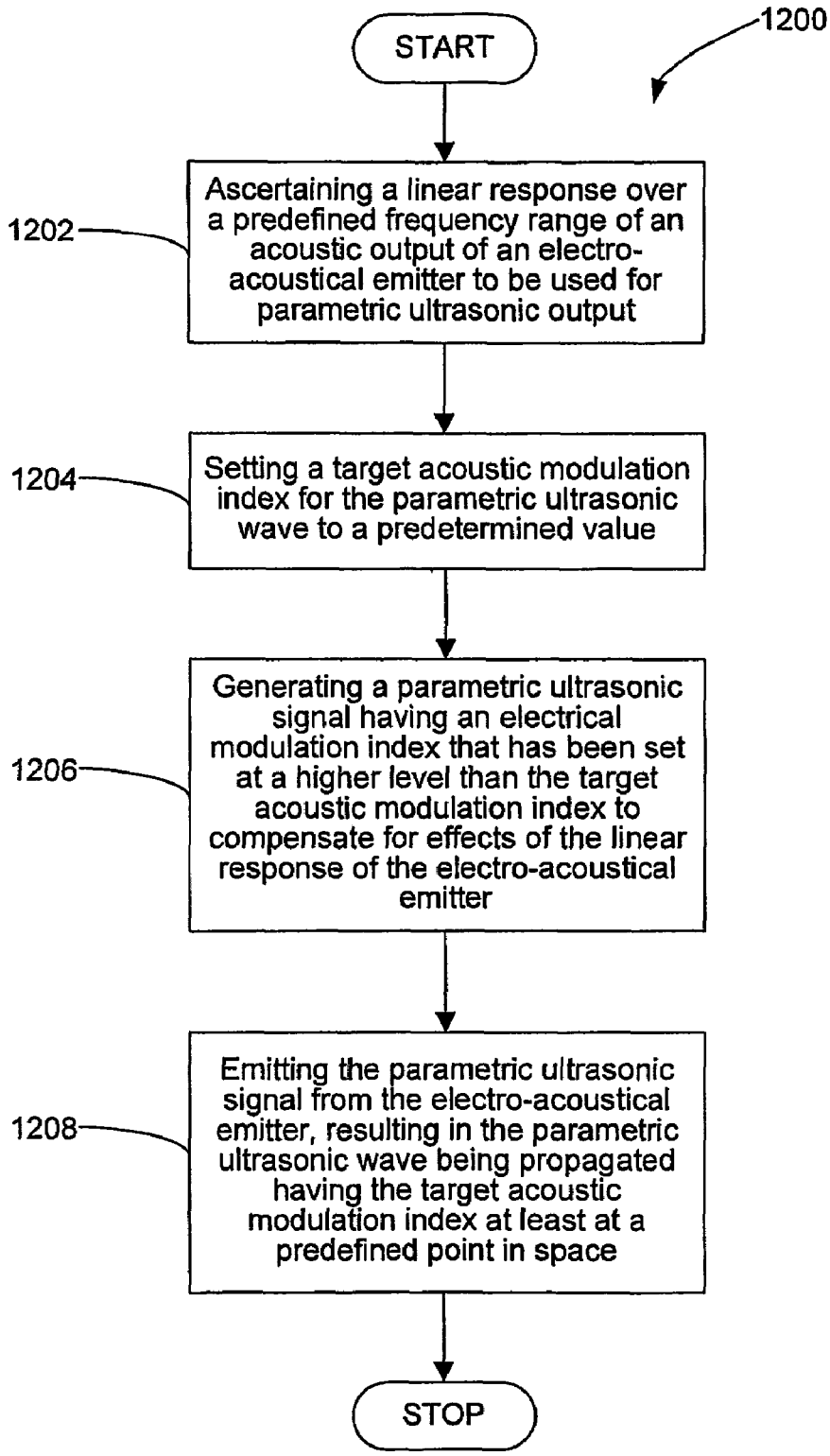
FIG. 12*a* is a flow diagram illustrating a method used to attain a parametric ultrasonic output wave having an optimized modulation index, in accordance with an embodiment of the present invention.

As illustrated in FIG. 12, a method 1200, in accordance with the present invention is shown for producing a parametric ultrasonic wave to be decoupled in air to create a decoupled audio wave that closely corresponds to an audio input signal. The method may include ascertaining 1202 a linear response over a predefined frequency range of an acoustic output of an electro-acoustical emitter to be used for parametric ultrasonic output. The method may further include setting 1204 a target acoustic modulation index for the parametric ultrasonic wave to a predetermined value. The method may further include generating 1206 a parametric ultrasonic signal having an electrical modulation index that has been set at a higher level than the target acoustic modulation index to compensate for effects of the linear response of the electro-acoustical emitter. The method may further include emitting 1208 the parametric ultrasonic signal from the electro-acoustical emitter, resulting in the parametric ultrasonic wave being propagated having the target acoustic modulation index at least at a predefined point in space.

FIGS. 2*a* and 1416 provide diagrams to demonstrate the process through which the method 1200 produce a parametric output signal having a target acoustic modulation index. FIG. 2*a* is an example of a frequency response 200 for an electro-acoustical emitter over a predefined frequency range to be used for parametric output. For the purpose of simplicity, the following examples focus only on the frequency response 200 of the emitter. However, it is to be remembered that the frequency response may also include the entire linear response of the acoustical output of an emitter, including environmental medium effects. The frequency response 200 has a resonance frequency 202 at 40 kHz, which may also be the frequency of the ultrasonic carrier signal. The emitter attenuates the frequencies above and below the resonance frequency.

Figure 14:
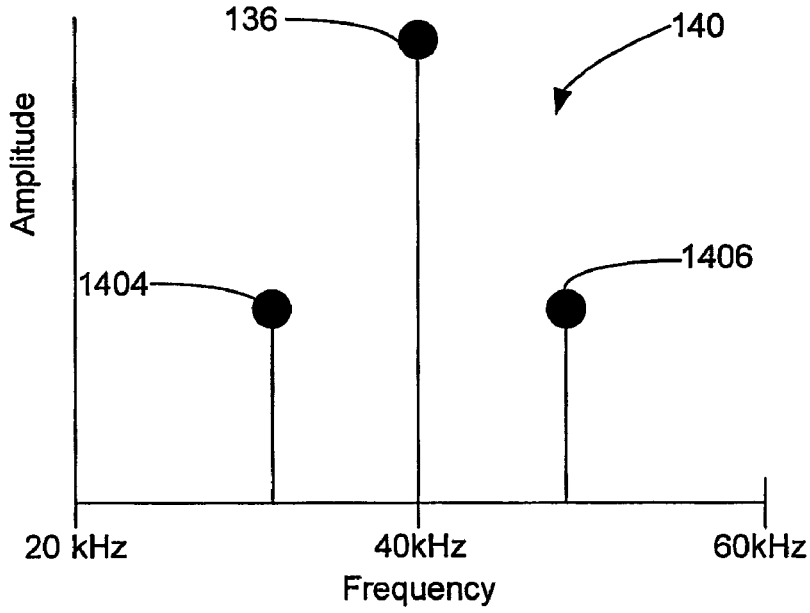
FIG. 14 is a frequency vs. amplitude plot of a parametric signal to be emitted from the electro-acoustical emitter in FIG. 2*a*.

FIG. 14 is an example of a parametric ultrasonic signal 140 (also see FIG. 1*c*) having an upper sideband 1406, a lower sideband 1404 and an ultrasonic carrier signal 136, resultant from the parametric modulation of an audio input signal 131 and an ultrasonic carrier signal 136 (see FIG. 1*c*). The resultant parametric ultrasonic signal has a modulation index, whose value is equal to the sum of the amplitudes of the sidebands divided by the amplitude of carrier signal. Therefore, the modulation index of a single sideband signal would merely be the amplitude of the one sideband divided by the amplitude of the carrier signal. For most purposes, a higher modulation index results in higher output efficiency, and higher output distortion, while a lower modulation index results in a low level of output distortion with sacrificed output efficiency. In the field of parametric sound, it is widely believed that a modulation index greater than one will result in very high output distortion, and is therefore avoided. Normally, parametric systems set the modulation index of the parametric ultrasonic signal at a level of 0.7 or less.

Designers of parametric loudspeakers have usually assumed that the electrical modulation index of the parametric ultrasonic signal 140 (FIG. 1*c*) must be optimized. Again, designers of parametric loudspeakers largely ignored the effects that the linear response of the acoustical output of an emitter may have on the acoustic modulation index of the parametric ultrasonic wave 148. However, it is the acoustic modulation index of the parametric ultrasonic wave 148 that determines the conversion efficiency when the parametric ultrasonic wave 148 decouples in air 150 to form the decoupled audio wave 152.

If the parametric ultrasonic signal 140 of FIG. 14 were emitted from the emitter described in FIG. 2A, the emitter would have attenuated the sidebands 1404 and 1406 more than it would have attenuated the ultrasonic carrier signal 136. This would result in a parametric ultrasonic wave 148 (see FIG. 1*c*) having an acoustic modulation index that is less than the original electric modulation index. Consequently, the acoustic modulation index of the parametric ultrasonic wave 148 would no longer be optimized. This unintended reduction in modulation index, regardless of the target modulation index value, causes reduced conversion efficiency and therefore reduced sound pressure level in the decoupled audio wave 152 of prior art parametric loudspeakers.

Figure 15:
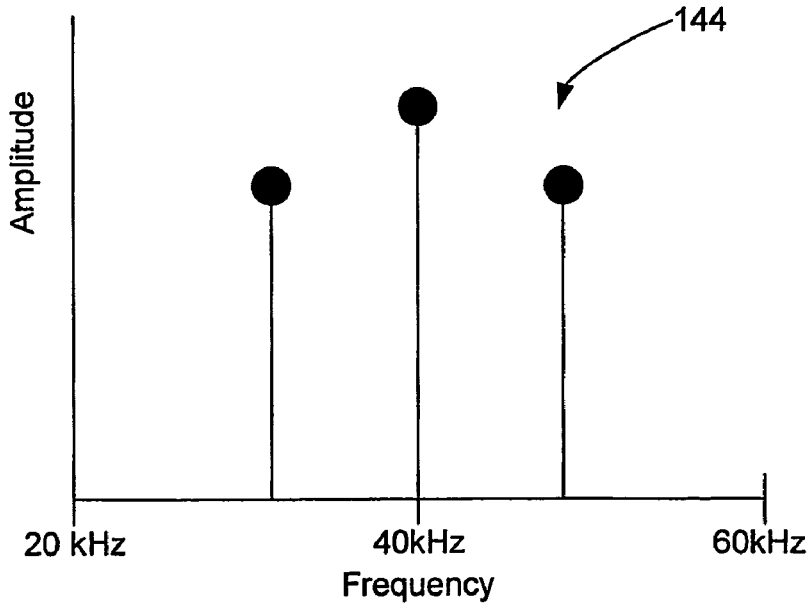
FIG. 15 is a frequency vs. amplitude plot of the parametric signal of FIG. 14 that has been modified such that the acoustic parametric output will have an optimized modulation index, in accordance with an embodiment of the present invention.

To solve this problem, the parametric ultrasonic signal may be created having an electrical modulation index at a higher level than the target acoustic modulation index in order to compensate for the effects of the linear response of the electro-acoustical emitter, as described in method 1200. FIG. 15 is an example of the electrical modulation index of a parametric ultrasonic signal 144 (see also FIG. 1*c*) created by adjusting the amplitudes of the upper and lower sidebands 1404 and 1406 of the parametric ultrasonic signal shown in FIG. 14 to compensate for the frequency response of the electro-acoustical emitter. Because the frequency response of the emitter in FIG. 2A has already been ascertained, a prediction can be made as to how much to adjust the upper and/or lower sideband frequencies so that when the parametric ultrasonic processed signal 144 is emitted through the emitter of FIG. 2A, the resultant parametric ultrasonic wave 148 will have the target acoustic modulation index.

Creating the parametric ultrasonic signal having an electrical modulation index at a higher level may be accomplished in one step during modulation, or may completed in a second step where the linear parameters of the parametric ultrasonic signal are adjusted after the step of modulation. While this particular example increased the amplitudes of the upper and lower sidebands, a similar and equally valid result may be obtained by decreasing the amplitude of the ultrasonic carrier signal. There also may be situations where the amplitude of only one sideband is adjusted. While this example dealt with a parametric ultrasonic signal having double sidebands, the principle used also applies to single sideband signals.

Figure 16:
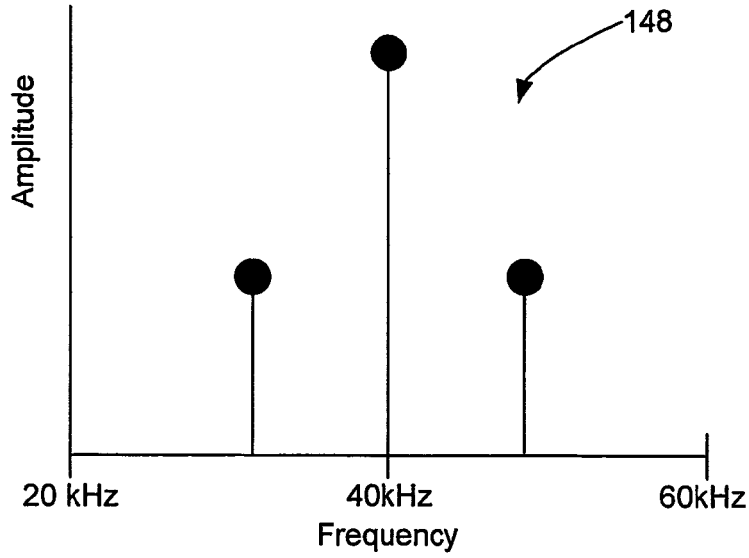
FIG. 16 is a frequency vs. amplitude plot of the acoustic parametric output that results from emitting the modified parametric signal from FIG. 15 from the electro-acoustical emitter in FIG. 2*a*.

FIG. 16 is an example of the acoustic modulation index of the parametric ultrasonic wave 148 that results when the parametric ultrasonic processed signal 144 of FIG. 15 is emitted from the emitter described in FIG. 2A. Notably, the acoustic modulation index of the parametric ultrasonic wave 148 in FIG. 16 closely matches the electrical modulation index of the original parametric ultrasonic signal 140 in FIG. 14. Thus, the parametric ultrasonic wave 148 has an acoustic modulation index that matches the optimal modulation index as desired by the designer.

The process of "optimizing" the acoustic modulation index of the parametric ultrasonic wave 148 may have different meanings. For example, an optimized modulation index may mean that the acoustic modulation index of the parametric ultrasonic wave 148 closely approximates an electrical modulation index of the parametric ultrasonic signal 140. Alternatively, an optimized modulation index may mean that the acoustic modulation index of the parametric ultrasonic wave 148 is close to, or less than one (where "one" occurs when the sum of the amplitudes of the sidebands equals the amplitude of the carrier signal). In another embodiment, the electrical modulation index is set at a level greater than one, and the resultant acoustic modulation index is at a level less than one. In sum, modification of the modulation index of a parametric ultrasonic signal in order to compensate for imperfections in the linear response of the acoustic output from an electro-acoustical emitter is within the scope of the present invention.

Figure 13:
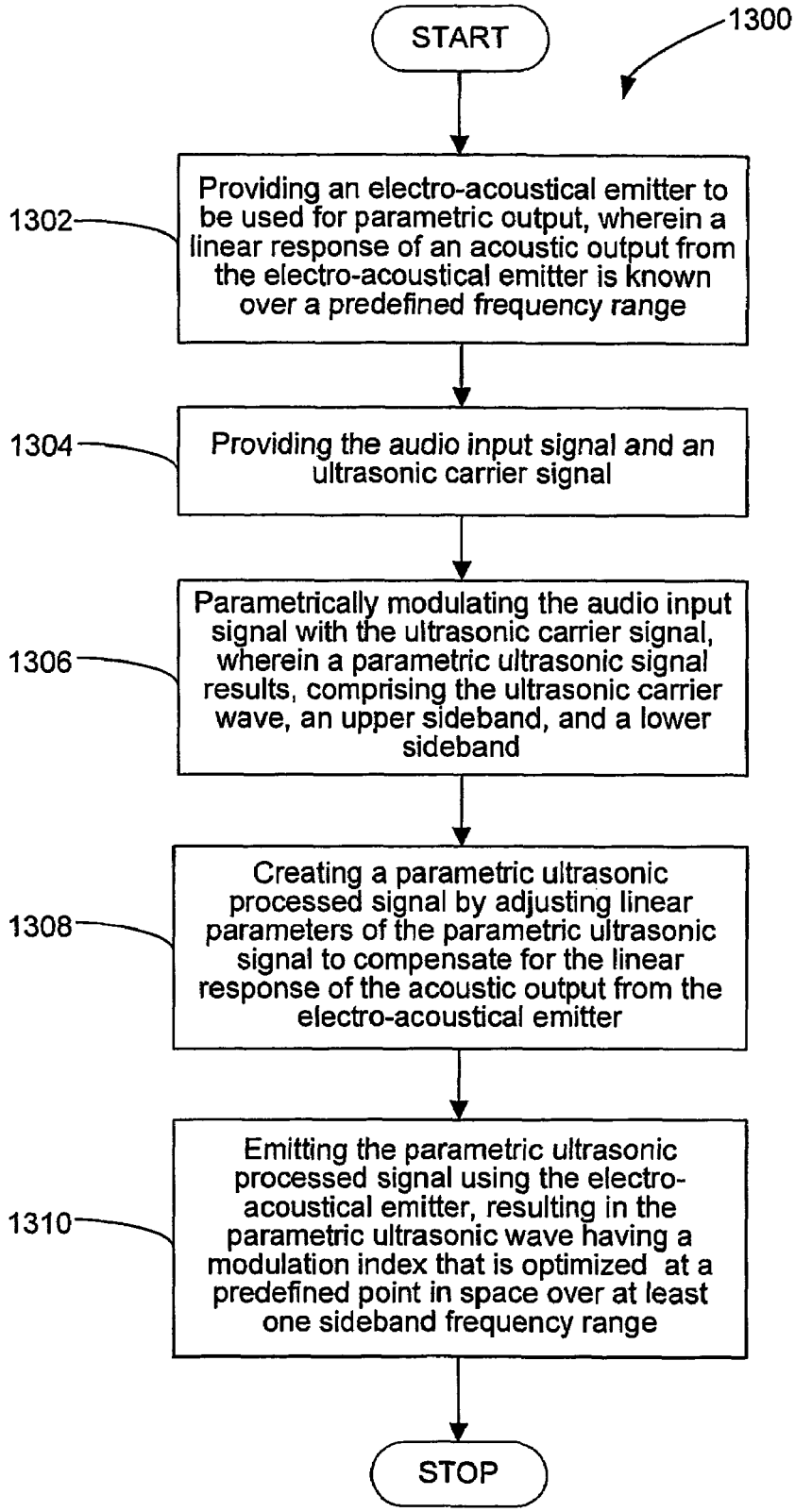
FIG. 13 is a flow diagram illustrating a more detailed method used to attain a parametric ultrasonic output wave having an optimized modulation index, in accordance with an embodiment of the present invention.

As illustrated in FIG. 13, a more detailed method 1300, in accordance with the present invention, is shown for producing a parametric ultrasonic wave to be decoupled in air to create a decoupled audio wave that closely corresponds to an audio input signal. The method may include providing 1302 an electro-acoustical emitter to be used for parametric output, wherein a linear response of an acoustic output from the electro-acoustical emitter is known over a predefined frequency range. The method may also include providing 1304 the audio input signal and an ultrasonic carrier signal. The method may also include parametrically modulating 1306 the audio input signal with the ultrasonic carrier signal, wherein a parametric ultrasonic signal results, comprising the ultrasonic carrier wave, an upper sideband, and a lower sideband. The method may also include creating 1308 a parametric ultrasonic processed signal by adjusting linear parameters of the parametric ultrasonic signal to compensate for the linear response of the acoustic output from the electro-acoustical emitter. The method may also include emitting 1310 the parametric ultrasonic processed signal using the electro-acoustical emitter, resulting in the parametric ultrasonic wave having a modulation index that is optimized at least at a predefined point in space over at least one sideband frequency range.

Methods 13 are inherently linked to methods 4, 5*a*, and 5*b*. In order to have an acoustic modulation index that is constant for all frequencies, it is necessary to have a linear response that is also constant for all frequencies. Therefore, it may be beneficial to combine the techniques described in 4, 5*a*, and 5*b* with the techniques described in 13 to attain a parametric ultrasonic wave having both a flat linear response and an acoustic modulation index that is optimized throughout the frequency range of interest.

Figure 17:
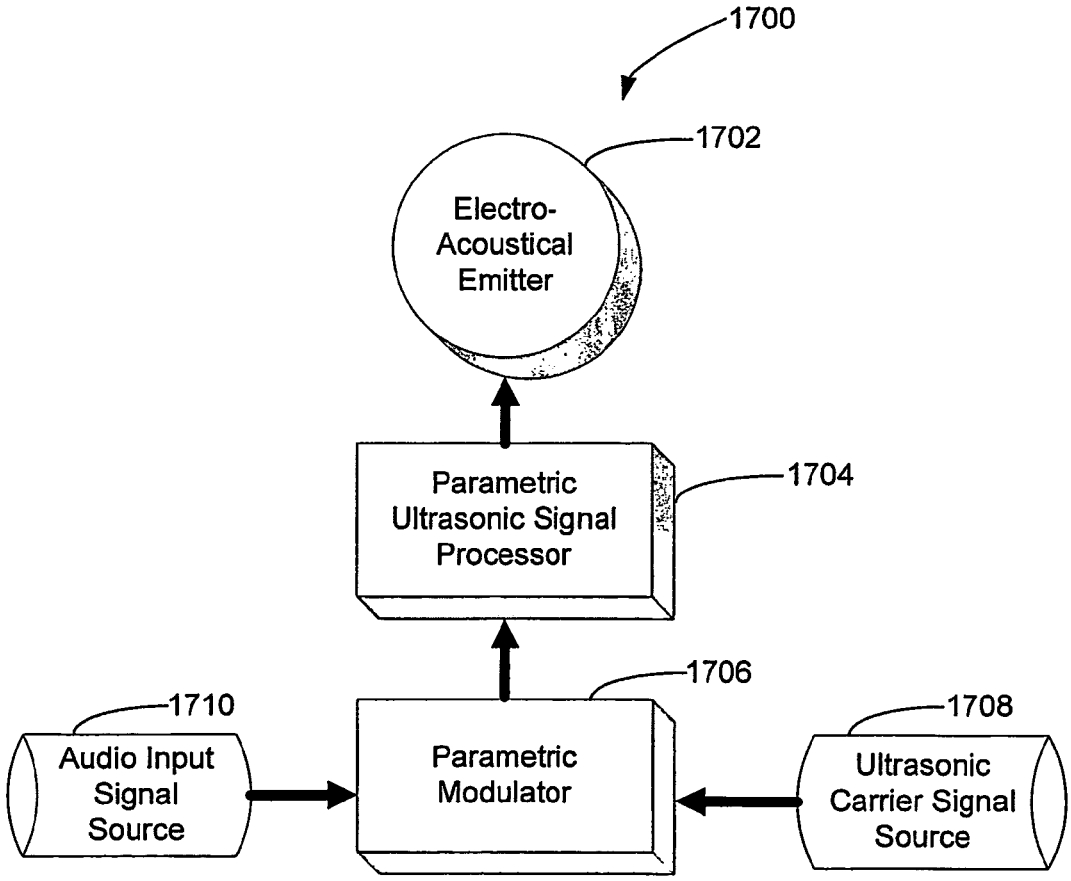
FIG. 17 is a block diagram of the system used to attain an acoustic parametric output having closely matched sidebands and an optimized modulation index, in accordance with an embodiment of the present invention.

As illustrated in FIG. 17, a system, indicated generally at 1700, in accordance with the present invention is shown for producing a parametric ultrasonic wave to be decoupled in air to create an audio output wave that closely corresponds to the audio input signal. The system includes at least an electro-acoustical transducer 1702, a parametric ultrasonic signal processor 1704, a parametric modulator 1706, an ultrasonic carrier signal source 1708, and an audio input signal source 1710. The electro-acoustical transducer 1702 has an emitter to be used for parametric output, wherein a linear response of an acoustic output from the electro-acoustical emitter is known over a predefined frequency range. The parametric ultrasonic signal processor 1704 may be electronically coupled to the electro-acoustical emitter 1702. The parametric ultrasonic signal processor is configured to modify amplitudes of a parametric ultrasonic signal to compensate for the linear response of an acoustic output from the electro-acoustical emitter such that when the parametric ultrasonic processed signal is emitted from the electro-acoustical emitter, the parametric ultrasonic wave is propagated, having sidebands that are closely matched. The parametric ultrasonic signal processor may be configured to further modify the linear parameters of the parametric ultrasonic signal to compensate for the linear response of the acoustic output from the electro-acoustical emitter such that when the parametric ultrasonic signal is emitted from the electro-acoustical emitter, the parametric ultrasonic wave is propagated, having a modulation index that is optimized. The parametric modulator 1706 may be electronically coupled to the parametric ultrasonic signal processor 1704. The parametric modulator 1706 is configured to modulate an ultrasonic carrier signal with the audio input signal to produce the parametric ultrasonic signal. The ultrasonic carrier signal is supplied by the ultrasonic carrier signal source 1708, and the audio input signal is supplied by the audio input signal source 1710.

While FIG. 17 portrays the parametric modulator 1706 and the parametric ultrasonic signal processor 1704 as two separate devices, the parametric modulator and the parametric ultrasonic signal processor may be combined into one device that performs both the parametric modulation and the signal processing.

The parametric ultrasonic signal processor 1704 may be implemented with a variety of filtering techniques. Examples of such filtering techniques include, but are not limited to, analog filters and various digital signal processing techniques.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

I claim:

1. A method of producing a parametric ultrasonic wave to be decoupled in air to create a decoupled audio wave that more closely corresponds to an audio input signal, the method comprising:

(a) ascertaining a linear response over a predefined frequency range of an acoustic output of an electro-acoustical emitter configured to be used for parametric ultrasonic output; and (b) creating a parametric ultrasonic processed signal by adjusting linear parameters of at least one sideband frequency range of a parametric ultrasonic signal to compensate for the linear response of the acoustic output of the electro-acoustical emitter such that content of an audio input signal and that of a decoupled audio wave more closely correspond.

2. A method in accordance with claim 1, wherein the linear response is a function of physical characteristics of the electro-acoustical emitter and a carrier frequency and a sound pressure level and an environmental medium wherein the parametric ultrasonic wave is propagated.

3. A method in accordance with claim 1, wherein at least one linear parameter is selected from the group consisting of amplitude, directivity, time delay, and phase.

4. A method in accordance to claim 1, further comprising the step of providing an electro-acoustical emitter that includes an electrically sensitive and mechanically responsive (ESMR) film.

5. A method in accordance to claim 1, further comprising the step of pre-equalizing amplitudes of the parametric ultrasonic signal to compensate for a naturally occurring attenuation in amplitude of output waves over sideband frequency ranges on at least one side of a carrier signal frequency.

6. A method in accordance with claim 1, wherein the adjustment is an amplitude correction having a value between zero and one times a magnitude of the amplitude value to which the adjustment is applied.

7. A method of producing a parametric ultrasonic wave to be decoupled in air to create a decoupled audio wave that closely corresponds to an audio input signal, the method comprising:

(a) ascertaining a linear response over a predefined frequency range of an acoustic output of an electro-acoustical emitter configured to be used for parametric ultrasonic output;

(b) setting a target acoustic modulation index for the parametric ultrasonic wave to a predetermined value;

(c) generating a parametric ultrasonic signal having an electrical modulation index that has been set at a higher level than the target acoustic modulation index to compensate for effects of the linear response of the electro-acoustical emitter; and (d) emitting the parametric ultrasonic signal from the electro-acoustical emitter, resulting in the parametric ultrasonic wave being propagated having the target acoustic modulation index at least at a predefined point in space.

8. A method in accordance with claim 7, comprising the more specific step of generating the parametric ultrasonic signal having an electrical modulation index greater than one, wherein the target acoustic modulation index is less than one.

9. A method in accordance with claim 7, comprising the more specific step of generating a parametric ultrasonic signal having a single sideband.

10. A method in accordance with claim 7, comprising the more specific step of generating a parametric ultrasonic signal having double sidebands.

11. A method in accordance with claim 7, wherein the linear response of the acoustic output is a function of physical characteristics of the electro-acoustical emitter, electrical signal parameters and conditions in an environmental medium wherein the parametric ultrasonic wave is propagated.

12. The method according to claim 7, wherein the step of generating a parametric ultrasonic signal having an electrical modulation index that has been set at a higher level than the target acoustic modulation index includes (i) creating a parametric ultrasonic signal by modulating a carrier signal with an audio input signal and (ii) adjusting the electrical modulation index of the parametric ultrasonic signal.

13. The method according to claim 12, wherein the step of adjusting the electrical modulation index includes decreasing the amplitude of a carrier wave.

14. The method according to claim 12, wherein the step of adjusting the electrical modulation index includes adjusting the linear parameters of at least one sideband of the parametric ultrasonic signal.

15. The method according to claim 7, wherein the linear parameters are selected from the group consisting of amplitude, directivity, time delay, and phase.

16. The method according to claim 7, wherein the electro-acoustical emitter includes an electrically sensitive and mechanically responsive (ESMR) film emitter.

17. A method of producing a parametric ultrasonic wave to be decoupled in air to create a decoupled audio wave that closely corresponds to an audio input signal, the method comprising:

(a) providing an electro-acoustical emitter configured to be used for parametric output, wherein a linear response of an acoustic output from the electro-acoustical emitter is known over a predefined frequency range;

(b) providing the audio input signal and an ultrasonic carrier signal;

(c) parametrically modulating the audio input signal with the ultrasonic carrier signal, wherein a parametric ultrasonic signal results, comprising:

(i) the ultrasonic carrier wave;

(ii) an upper sideband; and (iii) a lower sideband;

(d) creating a parametric ultrasonic processed signal by adjusting linear parameters of the parametric ultrasonic signal to compensate for effects of the linear response of the acoustic output from the electro-acoustical emitter; and (e) emitting the parametric ultrasonic processed signal using the electro-acoustical emitter, resulting in the parametric ultrasonic wave having a modulation index that closely approximates a modulation index of the electrical parametric signal at least at a predefined point in space over at least one sideband frequency range.

18. A method in accordance with claim 17, comprising the more specific step of adjusting linear parameters of the carrier wave so that the modulation index of the parametric ultrasonic wave is optimized at the predefined point in space.

19. A method in accordance with claim 17, wherein the linear parameters are selected from the group consisting of amplitude, directivity, time delay, and phase.

20. A method in accordance with claim 17, comprising the more specific step of providing an electro-acoustical emitter comprised of an electrically sensitive and mechanically responsive (ESMR) film emitter.

21. A method for improving fidelity in parametric audio reproduction of content of an audio signal in an air medium, comprising:

determining a typical amplitude response over a selected frequency range including at least a portion of each of upper and lower sideband frequency ranges of a parametric emitter of a selected design and selected parameter values, including at least one carrier frequency and at least one output sound pressure level;

determining any difference in sideband response over the upper and lower sideband frequency ranges;

determining any amplitude correction needed to account for any difference in sideband response over at least a portion of said frequency ranges within the selected frequency range for said emitter;

providing for applying any needed amplitude correction to a modulated ultrasonic carrier signal configured to be reproduced in an emitter of the selected design using said selected parameter values over at least a portion of at least one of the upper and lower sideband frequency ranges within the selected frequency range to correct for said difference in response of such emitter over the upper and lower sideband frequencies, giving lower distortion of the content of the audio signal when reproduced in an air medium.

22. A method in accordance with claim 21, wherein the step of providing for applying any needed amplitude correction further comprises the more specific step of applying a correction greater than zero and less than one times the magnitude of the amplitude value to which the correction is applied.

23. A method for improving the fidelity of parametric audio reproduction of content of an audio signal in an air medium, comprising the steps of:

characterizing a sideband amplitude response of a parametric emitter applying a correction in generating a modulated carrier signal for parametric reproduction of content of an audio signal which accounts for asymmetry in sideband response of said emitter.

* * * * *